US008894430B2

(12) United States Patent
Simon et al.

(10) Patent No.: US 8,894,430 B2
(45) **Date of Patent: *Nov. 25, 2014**

(54) MECHANISMS FOR REDUCING RISK OF SHOCK DURING INSTALLATION OF LIGHT TUBE

(71) Applicant: iLumisys, Inc., Troy, MI (US)

(72) Inventors: David Simon, Grosse Pointe Woods, MI (US); John Ivey, Farmington Hills, MI (US); Philip Kosarek, Shelby Township, MI (US); Craig Mackiewicz, Clawson, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/012,047

(22) Filed: Aug. 28, 2013

(65) Prior Publication Data

US 2014/0003054 A1 Jan. 2, 2014

Related U.S. Application Data

(63) Continuation of application No. 13/284,008, filed on Oct. 28, 2011, now Pat. No. 8,523,394.

(60) Provisional application No. 61/407,962, filed on Oct. 29, 2010.

(51) Int. Cl.

| | |
|---|---|
| ***H01R 33/96*** | (2006.01) |
| ***F21K 99/00*** | (2010.01) |
| ***H05B 33/08*** | (2006.01) |
| ***F21V 25/04*** | (2006.01) |
| *F21Y 103/00* | (2006.01) |
| *F21Y 101/02* | (2006.01) |

(52) U.S. Cl.

CPC ..... *F21K 9/175* (2013.01); *F21Y 2103/003* (2013.01); *H05B 33/0806* (2013.01); *H01R 33/96* (2013.01); *F21Y 2101/02* (2013.01); *F21V 25/04* (2013.01)

USPC ..... 439/226

(58) Field of Classification Search

USPC ..... 439/226; 362/221, 650, 234; 315/121; 313/300; 200/341

See application file for complete search history.

(56) References Cited

U.S. PATENT DOCUMENTS

| | | | |
|---|---|---|---|
| D54,511 | S | 2/1920 | Owen |
| D58,105 | S | 6/1921 | Poritz |

(Continued)

FOREIGN PATENT DOCUMENTS

| | | | |
|---|---|---|---|
| CN | 1584388 | A | 2/2005 |
| CN | 2766345 | Y | 3/2006 |

(Continued)

OTHER PUBLICATIONS

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.

(Continued)

*Primary Examiner* — Alexander Gilman

(74) *Attorney, Agent, or Firm* — Young Basile

(57) ABSTRACT

Disclosed herein is an LED-based light for replacing a fluorescent bulb in a conventional fluorescent light fixture. The LED-based light includes a housing having a first end opposing a second end, a circuit board disposed within the housing and extending along a longitudinal axis of the housing, at least one LED mounted to the circuit board, at least one end cap disposed on one of the first and second ends of the housing, the end cap including a switch and at least one electrically conductive pin configured for physical and electrical connection to the light fixture; and circuitry configured to provide a current path between the at least one LED and the at least one electrically conductive pin, wherein the switch is configured to selectively disconnect the current path.

19 Claims, 7 Drawing Sheets

(56) References Cited

U.S. PATENT DOCUMENTS

| | | | |
|---|---|---|---|
| D79,814 | S | 11/1929 | Hoch |
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenberg |
| 2,909,097 | A | 10/1959 | Alden et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,821,590 | A | 6/1974 | Kosman et al. |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,009,394 | A | 2/1977 | Mierzwinski |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,257,672 | A | 3/1981 | Balliet |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,727,457 | A | 2/1988 | Thillays |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,767,172 | A | 8/1988 | Hubble, III et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,851,972 | A | 7/1989 | Atlman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,001,609 | A | 3/1991 | Gardner et al. |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,761 | A | 7/1992 | Tanaka |

(56) References Cited

U.S. PATENT DOCUMENTS

| | | | |
|---|---|---|---|
| 5,130,909 | A | 7/1992 | Gross |
| 5,134,387 | A | 7/1992 | Smith et al. |
| 5,136,483 | A | 8/1992 | Schnogier et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,268,828 | A | 12/1993 | Miura |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,365,411 | A | 11/1994 | Rycroft et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,094 | A | 4/1995 | Green et al. |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |
| 5,412,552 | A | 5/1995 | Fernandes |
| 5,420,482 | A | 5/1995 | Phares |
| 5,421,059 | A | 6/1995 | Leffers, Jr. |
| 5,430,356 | A | 7/1995 | Ference et al. |
| 5,432,408 | A | 7/1995 | Matsuda et al. |
| 5,436,535 | A | 7/1995 | Yang |
| 5,436,853 | A | 7/1995 | Shimohara |
| 5,450,301 | A | 9/1995 | Waltz et al. |
| 5,461,188 | A | 10/1995 | Drago et al. |
| 5,463,280 | A | 10/1995 | Johnson |
| 5,463,502 | A | 10/1995 | Savage, Jr. |
| 5,465,144 | A | 11/1995 | Parker et al. |
| 5,473,522 | A | 12/1995 | Kriz et al. |
| 5,475,300 | A | 12/1995 | Havel |
| 5,481,441 | A | 1/1996 | Stevens |
| 5,489,827 | A | 2/1996 | Xia |
| 5,491,402 | A | 2/1996 | Small |
| 5,493,183 | A | 2/1996 | Kimball |
| 5,504,395 | A | 4/1996 | Johnson et al. |
| 5,506,760 | A | 4/1996 | Giebler et al. |
| 5,513,082 | A | 4/1996 | Asano |
| 5,519,496 | A | 5/1996 | Borgert et al. |
| 5,530,322 | A | 6/1996 | Ference et al. |
| 5,544,809 | A | 8/1996 | Keating et al. |
| 5,545,950 | A | 8/1996 | Cho |
| 5,550,440 | A | 8/1996 | Allison et al. |
| 5,559,681 | A | 9/1996 | Duarte |
| 5,561,346 | A | 10/1996 | Byrne |
| D376,030 | S | 11/1996 | Cohen |
| 5,575,459 | A | 11/1996 | Anderson |
| 5,575,554 | A | 11/1996 | Guritz |
| 5,581,158 | A | 12/1996 | Quazi |
| 5,592,051 | A | 1/1997 | Korkala |
| 5,592,054 | A | 1/1997 | Nerone et al. |
| 5,600,199 | A | 2/1997 | Martin, Sr. et al. |
| 5,607,227 | A | 3/1997 | Yasumoto et al. |
| 5,608,290 | A | 3/1997 | Hutchisson et al. |
| 5,614,788 | A | 3/1997 | Mullins et al. |
| 5,621,282 | A | 4/1997 | Haskell |
| 5,621,603 | A | 4/1997 | Adamec et al. |
| 5,621,662 | A | 4/1997 | Humphries et al. |
| 5,622,423 | A | 4/1997 | Lee |
| 5,633,629 | A | 5/1997 | Hochstein |
| 5,634,711 | A | 6/1997 | Kennedy et al. |
| 5,639,158 | A | 6/1997 | Sato |
| 5,640,061 | A | 6/1997 | Bornhorst et al. |
| 5,640,141 | A | 6/1997 | Myllymaki |
| 5,640,792 | A | 6/1997 | O'Shea et al. |
| 5,642,129 | A | 6/1997 | Zavracky et al. |
| 5,655,830 | A | 8/1997 | Ruskouski |
| 5,656,935 | A | 8/1997 | Havel |
| 5,661,374 | A | 8/1997 | Cassidy et al. |
| 5,661,645 | A | 8/1997 | Hochstein |
| 5,673,059 | A | 9/1997 | Zavracky et al. |
| 5,682,103 | A | 10/1997 | Burrell |
| 5,684,523 | A | 11/1997 | Satoh et al. |
| 5,688,042 | A | 11/1997 | Madadi et al. |
| 5,690,417 | A | 11/1997 | Choate et al. |
| 5,697,695 | A | 12/1997 | Lin et al. |
| 5,699,243 | A | 12/1997 | Eckel et al. |
| 5,701,058 | A | 12/1997 | Roth |
| 5,712,650 | A | 1/1998 | Barlow |
| 5,713,655 | A | 2/1998 | Blackman |
| 5,721,471 | A | 2/1998 | Begemann et al. |
| 5,725,148 | A | 3/1998 | Hartman |
| 5,726,535 | A | 3/1998 | Yan |
| 5,731,759 | A | 3/1998 | Finucan |
| 5,734,590 | A | 3/1998 | Tebbe |
| 5,751,118 | A | 5/1998 | Mortimer |
| 5,752,766 | A | 5/1998 | Bailey et al. |
| 5,765,940 | A | 6/1998 | Levy et al. |
| 5,769,527 | A | 6/1998 | Taylor et al. |
| 5,784,006 | A | 7/1998 | Hochstein |
| 5,785,227 | A | 7/1998 | Akiba |
| 5,790,329 | A | 8/1998 | Klaus et al. |
| 5,803,579 | A | 9/1998 | Turnbull et al. |
| 5,803,580 | A | 9/1998 | Tseng |
| 5,803,729 | A | 9/1998 | Tsimerman |
| 5,806,965 | A | 9/1998 | Deese |
| 5,808,689 | A | 9/1998 | Small |
| 5,810,463 | A | 9/1998 | Kawahara et al. |
| 5,812,105 | A | 9/1998 | Van de Ven |
| 5,813,751 | A | 9/1998 | Shaffer |
| 5,813,753 | A | 9/1998 | Vriens et al. |
| 5,821,695 | A | 10/1998 | Vilanilam et al. |
| 5,825,051 | A | 10/1998 | Bauer et al. |
| 5,828,178 | A | 10/1998 | York et al. |
| 5,831,522 | A | 11/1998 | Weed et al. |
| 5,836,676 | A | 11/1998 | Ando et al. |
| 5,848,837 | A | 12/1998 | Gustafson |
| 5,850,126 | A | 12/1998 | Kanbar |
| 5,851,063 | A | 12/1998 | Doughty et al. |
| 5,852,658 | A | 12/1998 | Knight et al. |
| 5,854,542 | A | 12/1998 | Forbes |
| RE36,030 | E | 1/1999 | Nadeau |
| 5,859,508 | A | 1/1999 | Ge et al. |
| 5,865,529 | A | 2/1999 | Yan |
| 5,870,233 | A | 2/1999 | Benz et al. |
| 5,890,794 | A | 4/1999 | Abtahi et al. |
| 5,893,633 | A | 4/1999 | Saito et al. |
| 5,896,010 | A | 4/1999 | Mikolajczak et al. |
| 5,904,415 | A | 5/1999 | Robertson et al. |
| 5,907,742 | A | 5/1999 | Johnson et al. |
| 5,909,378 | A | 6/1999 | De Milleville |
| 5,912,653 | A | 6/1999 | Fitch |
| 5,917,287 | A | 6/1999 | Haederle et al. |

(56) References Cited

U.S. PATENT DOCUMENTS 5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
6,031,958 A 2/2000 McGaffigan
6,036,335 A 3/2000 Openiano
6,036,336 A 3/2000 Wu
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,115,184 A 9/2000 Hubble, III et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,234,645 B1 5/2001 Börner et al.
6,238,075 B1 5/2001 Dealey, Jr. et al.
6,240,665 B1 6/2001 Brown et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
6,380,865 B1 4/2002 Pederson
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.

(56) References Cited

U.S. PATENT DOCUMENTS 6,583,550 B2 6/2003 Iwasa et al.
6,583,573 B2 6/2003 Bierman
D477,093 S 7/2003 Moriyama et al.
6,585,393 B1 7/2003 Brandes et al.
6,586,890 B2 7/2003 Min et al.
6,590,343 B2 7/2003 Pederson
6,592,238 B2 7/2003 Cleaver et al.
6,594,369 B1 7/2003 Une
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,609,813 B1 8/2003 Showers et al.
6,612,712 B2 9/2003 Nepil
6,612,717 B2 9/2003 Yen
6,612,729 B1 9/2003 Hoffman
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,525 B2 5/2004 Chin
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
D506,274 S 6/2005 Moriyama et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,029,145 B2 * 4/2006 Frederick ..... 362/234
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 * 5/2006 Lefebvre et al. ..... 362/649
7,053,557 B2 5/2006 Cross et al.
7,064,498 B2 6/2006 Dowling et al.
7,064,674 B2 6/2006 Pederson
7,067,992 B2 * 6/2006 Leong et al. ..... 315/291
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 * 10/2006 Rivas et al. ..... 362/373
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.

(56) References Cited

U.S. PATENT DOCUMENTS

| | | | |
|---|---|---|---|
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| 7,274,183 | B1 | 9/2007 | Gu et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 * | 1/2009 | Chan ..... 362/240 |
| 7,478,924 | B2 | 1/2009 | Robertson |
| 7,482,764 | B2 | 1/2009 | Morgan et al. |
| D586,484 | S | 2/2009 | Liu et al. |
| D586,928 | S | 2/2009 | Liu et al. |
| 7,490,957 | B2 | 2/2009 | Leong et al. |
| 7,497,596 | B2 | 3/2009 | Ge |
| 7,498,753 | B2 | 3/2009 | McAvoy et al. |
| 7,507,001 | B2 * | 3/2009 | Kit ..... 362/276 |
| 7,510,299 | B2 | 3/2009 | Timmermans et al. |
| 7,510,400 | B2 | 3/2009 | Glovatsky et al. |
| 7,514,876 | B2 | 4/2009 | Roach, Jr. |
| 7,520,635 | B2 | 4/2009 | Wolf et al. |
| 7,521,872 | B2 | 4/2009 | Bruning |

(56) References Cited

U.S. PATENT DOCUMENTS 7,524,089 B2 4/2009 Park
D592,766 S 5/2009 Zhu et al.
D593,223 S 5/2009 Komar
7,530,701 B2 5/2009 Chan-Wing
7,534,002 B2 5/2009 Yamaguchi et al.
D594,999 S 6/2009 Uchida et al.
7,549,769 B2 6/2009 Kim et al.
7,556,396 B2 7/2009 Kuo et al.
7,559,663 B2 7/2009 Wong et al.
7,562,998 B1 7/2009 Yen
D597,686 S 8/2009 Noh
7,569,981 B1 * 8/2009 Ciancanelli ..... 313/300
7,572,030 B2 8/2009 Booth et al.
7,575,339 B2 8/2009 Hung
7,579,786 B2 8/2009 Soos
7,583,035 B2 9/2009 Shteynberg et al.
7,583,901 B2 9/2009 Nakagawa et al.
7,594,738 B1 9/2009 Lin et al.
D601,726 S 10/2009 Mollaert et al.
7,598,681 B2 10/2009 Lys et al.
7,598,684 B2 10/2009 Lys et al.
7,598,686 B2 10/2009 Lys et al.
7,600,907 B2 10/2009 Liu et al.
7,602,559 B2 10/2009 Jang et al.
7,618,157 B1 11/2009 Galvez et al.
7,619,366 B2 11/2009 Diederiks
7,635,201 B2 12/2009 Deng
7,635,214 B2 12/2009 Perlo
7,639,517 B2 12/2009 Zhou et al.
7,648,251 B2 1/2010 Whitehouse et al.
7,649,327 B2 1/2010 Peng
D610,724 S 2/2010 Chiang et al.
7,661,839 B2 2/2010 Tsai
D612,528 S 3/2010 McGrath et al.
7,690,813 B2 4/2010 Kanamori et al.
7,710,047 B2 5/2010 Shteynberg et al.
7,710,253 B1 5/2010 Fredricks
7,712,918 B2 5/2010 Siemiet et al.
7,748,886 B2 * 7/2010 Pazula et al. ..... 362/650
7,758,207 B1 7/2010 Zhou et al.
7,759,881 B1 7/2010 Melanson
D621,975 S 8/2010 Wang
7,784,966 B2 8/2010 Verfuerth et al.
7,800,511 B1 9/2010 Hutchison et al.
7,815,338 B2 10/2010 Siemiet et al.
7,815,341 B2 10/2010 Steedly et al.
7,828,471 B2 11/2010 Lin
7,843,150 B2 11/2010 Wang et al.
7,848,702 B2 12/2010 Ho et al.
7,850,341 B2 12/2010 Mrakovich et al.
RE42,161 E 2/2011 Hochstein
7,878,683 B2 2/2011 Logan et al.
7,887,216 B2 2/2011 Patrick
7,887,226 B2 2/2011 Huang et al.
7,889,051 B1 2/2011 Billig et al.
D634,452 S 3/2011 de Visser
7,926,975 B2 4/2011 Siemiet et al.
7,938,562 B2 5/2011 Ivey et al.
7,946,729 B2 5/2011 Ivey et al.
7,952,292 B2 5/2011 Vegter et al.
7,976,185 B2 * 7/2011 Uang et al. ..... 362/240
7,976,196 B2 7/2011 Ivey et al.
7,990,070 B2 8/2011 Nerone
7,997,770 B1 8/2011 Meurer
8,013,472 B2 9/2011 Adest et al.
D650,097 S 12/2011 Trumble et al.
D650,494 S 12/2011 Tsao et al.
D652,968 S 1/2012 Aguiar et al.
8,093,823 B1 1/2012 Ivey et al.
D654,192 S 2/2012 Maxik et al.
8,118,447 B2 2/2012 Simon et al.
8,147,091 B2 * 4/2012 Hsia et al. ..... 362/221
8,159,152 B1 4/2012 Salessi
D660,472 S 5/2012 Aguiar et al.
8,167,452 B2 5/2012 Chou
8,177,388 B2 5/2012 Yen
8,179,037 B2 5/2012 Chan et al.
8,183,989 B2 5/2012 Tsai
D662,236 S 6/2012 Matsushita
8,203,445 B2 6/2012 Recker et al.
8,214,084 B2 7/2012 Ivey et al.
8,247,985 B2 8/2012 Timmermans et al.
8,251,544 B2 8/2012 Ivey et al.
8,262,249 B2 * 9/2012 Hsia et al. ..... 362/217.1
8,272,764 B2 9/2012 Son
8,287,144 B2 10/2012 Pedersen et al.
8,297,788 B2 10/2012 Bishop
8,299,722 B2 10/2012 Melanson
8,304,993 B2 11/2012 Tzou et al.
8,313,213 B2 11/2012 Lin et al.
8,319,407 B2 11/2012 Ke
8,319,433 B2 11/2012 Lin et al.
8,319,437 B2 11/2012 Carlin et al.
8,322,878 B2 * 12/2012 Hsia et al. ..... 362/221
8,324,817 B2 12/2012 Ivey et al.
8,337,071 B2 12/2012 Negley et al.
8,376,579 B2 2/2013 Chang
8,376,588 B2 2/2013 Yen
8,382,322 B2 2/2013 Bishop
8,382,327 B2 2/2013 Timmermans et al.
8,382,502 B2 * 2/2013 Cao et al. ..... 439/226
8,388,179 B2 3/2013 Hood et al.
8,398,275 B2 3/2013 Wang et al.
8,403,692 B2 3/2013 Cao et al.
8,405,314 B2 3/2013 Jensen
8,434,914 B2 5/2013 Li et al.
8,454,193 B2 6/2013 Simon et al.
8,482,212 B1 7/2013 Ivey et al.
8,523,394 B2 * 9/2013 Simon et al. ..... 362/249.05
8,531,109 B2 * 9/2013 Visser et al. ..... 315/88
8,571,716 B2 10/2013 Ivey et al.
8,653,984 B2 * 2/2014 Ivey et al. ..... 340/815.4
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0041159 A1 4/2002 Kaping
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.

(56) References Cited

U.S. PATENT DOCUMENTS

2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0166634 A1 8/2005 Lieberman et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Chaeng et al.
2005/0243577 A1 11/2005 Moon
2005/0248299 A1 11/2005 Chemel et al.
2005/0253533 A1 11/2005 Lys et al.
2005/0259424 A1 11/2005 Zampini, II et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0091826 A1 5/2006 Chen
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0215422 A1 9/2006 Laizure, Jr. et al.
2006/0220595 A1 10/2006 Lu
2006/0221606 A1 10/2006 Dowling et al.
2006/0221619 A1* 10/2006 Nishigaki ..... 362/341
2006/0227558 A1 10/2006 Osawa et al.
2006/0232974 A1 10/2006 Lee et al.
2006/0238884 A1 10/2006 Jang et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0265921 A1 11/2006 Korall et al.
2006/0273741 A1 12/2006 Stalker, III
2006/0274529 A1 12/2006 Cao

(56) References Cited

U.S. PATENT DOCUMENTS

2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0064425 A1 3/2007 Frecska et al.
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120463 A1 5/2007 Hayashi et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0146126 A1 6/2007 Wang
2007/0147046 A1 6/2007 Arik et al.
2007/0152797 A1 7/2007 Chemel et al.
2007/0152808 A1 7/2007 LaCasse
2007/0153514 A1 7/2007 Dowling et al.
2007/0159828 A1 7/2007 Wang
2007/0165402 A1 7/2007 Weaver, Jr. et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0029720 A1 2/2008 Li
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0185961 A1 8/2008 Hong
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0010022 A1 1/2009 Tsai
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0073693 A1 3/2009 Nall et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0189548 A1 7/2009 Huang et al.
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.

(56) References Cited

U.S. PATENT DOCUMENTS

| | | | | |
|---|---|---|---|---|
| 2009/0273924 | A1 | 11/2009 | Chiang | |
| 2009/0273926 | A1 | 11/2009 | Deng | |
| 2009/0284169 | A1 | 11/2009 | Valois | |
| 2009/0290334 | A1 | 11/2009 | Ivey et al. | |
| 2009/0295776 | A1 | 12/2009 | Yu et al. | |
| 2009/0296381 | A1 | 12/2009 | Dubord | |
| 2009/0303720 | A1 | 12/2009 | McGrath | |
| 2009/0316408 | A1 | 12/2009 | Villard | |
| 2010/0008085 | A1 | 1/2010 | Ivey et al. | |
| 2010/0019689 | A1 | 1/2010 | Shan | |
| 2010/0027259 | A1 | 2/2010 | Simon et al. | |
| 2010/0033095 | A1 | 2/2010 | Sadwick | |
| 2010/0033964 | A1 | 2/2010 | Choi et al. | |
| 2010/0046210 | A1 | 2/2010 | Mathai et al. | |
| 2010/0046222 | A1 | 2/2010 | Yang | |
| 2010/0071946 | A1 | 3/2010 | Hashimoto | |
| 2010/0073944 | A1 | 3/2010 | Chen | |
| 2010/0079085 | A1 | 4/2010 | Wendt et al. | |
| 2010/0096992 | A1 | 4/2010 | Yamamoto et al. | |
| 2010/0096998 | A1 | 4/2010 | Beers | |
| 2010/0103664 | A1 | 4/2010 | Simon et al. | |
| 2010/0103673 | A1 | 4/2010 | Ivey et al. | |
| 2010/0109550 | A1 | 5/2010 | Huda et al. | |
| 2010/0109558 | A1 | 5/2010 | Chew | |
| 2010/0141173 | A1 | 6/2010 | Negrete | |
| 2010/0148650 | A1 | 6/2010 | Wu et al. | |
| 2010/0149806 | A1 | 6/2010 | Yiu | |
| 2010/0157608 | A1 | 6/2010 | Chen et al. | |
| 2010/0164404 | A1 | 7/2010 | Shao et al. | |
| 2010/0181178 | A1* | 7/2010 | Chang et al. | 200/341 |
| 2010/0201269 | A1 | 8/2010 | Tzou et al. | |
| 2010/0207547 | A1 | 8/2010 | Kuroki et al. | |
| 2010/0220469 | A1 | 9/2010 | Ivey et al. | |
| 2010/0237790 | A1 | 9/2010 | Peng | |
| 2010/0265732 | A1 | 10/2010 | Liu | |
| 2010/0270925 | A1 | 10/2010 | Withers | |
| 2010/0277069 | A1 | 11/2010 | Janik et al. | |
| 2010/0289418 | A1 | 11/2010 | Langovsky | |
| 2010/0308733 | A1 | 12/2010 | Shao | |
| 2010/0309652 | A1 | 12/2010 | Shen et al. | |
| 2010/0320922 | A1 | 12/2010 | Palazzolo et al. | |
| 2011/0006658 | A1 | 1/2011 | Chan et al. | |
| 2011/0090682 | A1 | 4/2011 | Zheng et al. | |
| 2011/0109454 | A1 | 5/2011 | McSheffrey, Sr. | |
| 2011/0112661 | A1 | 5/2011 | Jung et al. | |
| 2011/0156584 | A1 | 6/2011 | Kim | |
| 2011/0176298 | A1 | 7/2011 | Meurer et al. | |
| 2011/0199723 | A1 | 8/2011 | Sato | |
| 2011/0199769 | A1 | 8/2011 | Bretschneider et al. | |
| 2011/0204777 | A1 | 8/2011 | Lenk | |
| 2011/0291588 | A1 | 12/2011 | Tagare | |
| 2012/0014086 | A1 | 1/2012 | Jonsson | |
| 2012/0043892 | A1* | 2/2012 | Visser et al. | 315/121 |
| 2012/0063140 | A1 | 3/2012 | Kong et al. | |
| 2012/0080994 | A1 | 4/2012 | Chin et al. | |
| 2012/0081891 | A1 | 4/2012 | Tung et al. | |
| 2012/0098439 | A1 | 4/2012 | Recker et al. | |
| 2012/0106144 | A1 | 5/2012 | Chang | |
| 2012/0113628 | A1 | 5/2012 | Burrow et al. | |
| 2012/0127726 | A1 | 5/2012 | Yen | |
| 2012/0146503 | A1 | 6/2012 | Negley et al. | |
| 2012/0147597 | A1 | 6/2012 | Farmer | |
| 2012/0153865 | A1 | 6/2012 | Rolfes et al. | |
| 2012/0155073 | A1 | 6/2012 | McCanless et al. | |
| 2012/0161666 | A1 | 6/2012 | Antony et al. | |
| 2012/0194086 | A1 | 8/2012 | Liu et al. | |
| 2012/0195032 | A1 | 8/2012 | Shew | |
| 2012/0212951 | A1 | 8/2012 | Lai et al. | |
| 2012/0212953 | A1 | 8/2012 | Bloom et al. | |
| 2012/0230044 | A1 | 9/2012 | Zhang et al. | |
| 2012/0236533 | A1 | 9/2012 | Nakamura et al. | |
| 2012/0236554 | A1 | 9/2012 | Rust | |
| 2012/0243216 | A1 | 9/2012 | Lai et al. | |
| 2012/0243217 | A1 | 9/2012 | Szprengiel et al. | |
| 2012/0274214 | A1 | 11/2012 | Radermacher et al. | |
| 2012/0275154 | A1 | 11/2012 | Hood et al. | |
| 2012/0293991 | A1 | 11/2012 | Lin | |
| 2012/0293996 | A1 | 11/2012 | Thomas et al. | |
| 2012/0300445 | A1 | 11/2012 | Chu et al. | |
| 2012/0300468 | A1 | 11/2012 | Chang et al. | |
| 2012/0300486 | A1 | 11/2012 | Matsushita et al. | |
| 2012/0307524 | A1 | 12/2012 | Schapira et al. | |
| 2012/0320598 | A1 | 12/2012 | Son | |
| 2013/0039051 | A1 | 2/2013 | Wu | |
| 2013/0044471 | A1 | 2/2013 | Chen | |
| 2013/0044476 | A1 | 2/2013 | Bretschneider et al. | |
| 2013/0050997 | A1 | 2/2013 | Bretschneider et al. | |
| 2013/0050998 | A1 | 2/2013 | Chu et al. | |
| 2013/0057146 | A1 | 3/2013 | Chao | |
| 2013/0058079 | A1 | 3/2013 | Dellian et al. | |
| 2013/0063944 | A1 | 3/2013 | Lodhie et al. | |
| 2013/0077297 | A1 | 3/2013 | Wu et al. | |
| 2013/0094200 | A1 | 4/2013 | Dellian et al. | |
| 2013/0148349 | A1 | 6/2013 | Pasqualini et al. | |
| 2013/0200797 | A1 | 8/2013 | Timmermans et al. | |
| 2013/0201690 | A1 | 8/2013 | Vissenberg et al. | |
| 2013/0206597 | A1 | 8/2013 | Wang et al. | |
| 2013/0221867 | A1 | 8/2013 | Deppe et al. | |
| 2013/0258668 | A1 | 10/2013 | Dellian et al. | |

FOREIGN PATENT DOCUMENTS

| | | | |
|---|---|---|---|
| CN | 2869556 | Y | 2/2007 |
| CN | 101016976 | A | 8/2007 |
| CN | 101075605 | A | 11/2007 |
| CN | 201129681 | Y | 10/2008 |
| CN | 201184574 | Y | 1/2009 |
| CN | 101737664 | A1 | 6/2010 |
| DE | 19651140 | A1 | 6/1997 |
| DE | 19624087 | A1 | 12/1997 |
| DE | 29819966 | U1 | 3/1999 |
| DE | 29900320 | U1 | 5/1999 |
| DE | 29817609 | U1 | 1/2000 |
| DE | 20018865 | U1 | 2/2001 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | | 1/1995 |
| EP | 0432848 | B1 | 4/1995 |
| EP | 0659531 | A1 | 6/1995 |
| EP | 0403001 | B1 | 8/1995 |
| EP | 0525876 | | 5/1996 |
| EP | 0714556 | | 1/1999 |
| EP | 0889283 | A1 | 7/1999 |
| EP | 0458408 | B1 | 9/1999 |
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |

(56) References Cited

FOREIGN PATENT DOCUMENTS

| | | | |
|---|---|---|---|
| EP | 1321012 | B1 | 12/2005 |
| EP | 1610593 | | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2333407 | A1 | 6/2011 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| GB | 2495647 | A | 4/2013 |
| JP | S68248271 | A | 10/1987 |
| JP | 06-054289 | | 2/1994 |
| JP | 07-249467 | | 9/1995 |
| JP | H11-135274 | A | 5/1999 |
| JP | 2001-238272 | A | 8/2001 |
| JP | 2001-291406 | A | 10/2001 |
| JP | 2002-141555 | A | 5/2002 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 5102530 | B2 | 12/2012 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | WO9906759 | A1 | 2/1999 |
| WO | WO9910867 | A1 | 3/1999 |
| WO | WO9931560 | A2 | 6/1999 |
| WO | WO9945312 | A1 | 9/1999 |
| WO | WO9957945 | A1 | 11/1999 |
| WO | WO0001067 | A2 | 1/2000 |
| WO | WO2011072308 | A1 | 6/2001 |
| WO | WO0225842 | A2 | 3/2002 |
| WO | WO02061330 | A2 | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |
| WO | WO03026358 | A1 | 3/2003 |
| WO | WO03055273 | A2 | 7/2003 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A2 | 4/2010 |
| WO | WO2010047898 | A2 | 4/2010 |
| WO | WO2010047973 | A2 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | | 1/2011 |
| WO | WO2011005579 | A2 | 1/2011 |
| WO | WO2011021719 | A1 | 2/2011 |
| WO | WO2011074884 | A2 | 6/2011 |
| WO | WO2011113709 | A1 | 9/2011 |
| WO | WO2011117059 | A1 | 9/2011 |
| WO | WO2011159436 | A2 | 12/2011 |
| WO | WO2012001584 | A1 | 1/2012 |
| WO | WO2012004708 | A2 | 1/2012 |
| WO | WO2012007899 | A1 | 1/2012 |
| WO | WO2012019535 | A1 | 2/2012 |
| WO | WO2012025626 | A1 | 3/2012 |
| WO | WO2012063174 | A2 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | WO2013097823 | A1 | 7/2013 |
| WO | WO2013098700 | A1 | 7/2013 |
| WO | WO2013113548 | A1 | 8/2013 |
| WO | WO2013113661 | A1 | 8/2013 |
| WO | WO2013121347 | A1 | 8/2013 |
| WO | WO2013156905 | A1 | 10/2013 |
| WO | WO2013167419 | A1 | 11/2013 |

OTHER PUBLICATIONS

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.htrnl>.

(56) References Cited

OTHER PUBLICATIONS

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.
D.N.A.-III, [online], [retrieved Mar. 10, 2009] Retrieved from the PLC Lighting Web Page using Internet <URL: http://www.plclighting.com/product_info.php?cPath=1&products_id=92>.
E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.
Extended European Search Report for co-pending European Application No. 10 73 2124 mailed on Dec. 13, 2012 in 8 pages.
Extended European Search Report for co-pending European Application No. 09822425.6 mailed on Aug. 30, 2012 in 9 pages.
Extended European Search Report for co-pending European Application No. 10797596.3 mailed on Jan. 17, 2013 in 11pages.
Extended European Search Report for co-pending European Application No. 10736237.8 mailed on Oct. 19, 2012 in 5 pages.
Extended European Search Report for co-pending European Application No. 10738925.6 mailed on Oct. 1, 2012 in 7 pages.
Extended European Search Report for co-pending European Application No. 10760309 mailed on Sep. 30, 2013 in 7 pages.
Examination and Search Report mailed on Jul. 2, 2012 in cooresponding United Kingdom Application No. 1018896.9 in 4 pages.
Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.
Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
International Search Report and Written Opinion dated May 24, 2010 from the corresponding International Application No. PCT/US2009/060087 filed Oct. 9, 2009.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009.
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Feb. 6, 2012 from the corresponding International Application No. PCT/US2011/043524 filed on Jul. 11, 2011.
International Search Report and Written Opinion dated Feb. 15, 2013 from the corresponding International Application No. PCT/US22012/052244 filed on Aug. 24, 2012.
International Search Report and Written Opinion dated Aug. 30, 2011 for the corresponding International Application No. PCT/US2011/029994 filed Mar. 25, 2011.
International Search Report and Written Opinion dated Aug. 13, 2013 for the corresponding International Application No. PCT/US2013/028669 filed Mar. 1, 2013.
International Search Report and Written Opinion dated Sep. 23, 2013 for the corresponding International Application No. PCT/US2013/049432 filed Jul. 5, 2013.

(56) References Cited

OTHER PUBLICATIONS

International Search Report and Written Opinion dated Oct. 10, 2013 for the corresponding International Application No. PCT/US2013/049427 filed Jul. 5, 2013.
Notification of Transmittal, the International Search Report and the Written Opinion of the International Searching Authority dated May 7, 2012, from the corresponding International Application No. PCT/US2011/064151.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
LEDTRONICS, LEDTRONICS Catalog, 1996, p. 10, LEDTRONICS, Torrance, California.
Phason Electronic Control Systems, Light Level Controller (LLC) case study. Nov. 30, 2004. 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.
PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.
Saha et al, "Location Determination of a Mobile Device using IEEE 802.11 Access Point Signals", May 5, 2002 in 20 pages.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Supplementary European Search Report for corresponding European Application No. 10797603.7 mailed Aug. 5, 2013 in 5 pages.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
Notification of Transmittal, the International Search Report and the Written Opinion of the International Searching Authority dated May 7, 2012 from the corresponding International Application No. PCT/US2011/058312.
Bose, "Modern Power Electronics, Evolution, Technology and Applications", 1992, IEEE Press, pp. 14-15.
Kularatna, "Power Electronics Design Handbook, Low-power Components and Applications", 1998, Newns, pp. 71-75.
Lighting Handbook, 8th Edition, Illuminating Engineering Society of North America, 1993, pp. 237-240.
Hodapp, "Chapter 6: Applications for High-Brightness Light-Emitting Diodes", Hodapp, Academic Press, 1997, pp. 334-336, "High Brightness Light Emitting Diodes", Stringfellow et al., volume editors.

* cited by examiner

MECHANISMS FOR REDUCING RISK OF SHOCK DURING INSTALLATION OF LIGHT TUBE

CROSS REFERENCE TO RELATED APPLICATION

This application is a continuation of U.S. patent application Ser. No. 13/284,008 filed Oct. 28, 2011, which claims priority to U.S. Provisional Patent Application No. 61/407,962, filed Oct. 29, 2010, both of which are incorporated herein by reference in their entireties.

TECHNICAL FIELD

The invention relates to a light emitting diode (LED) based light usable in a conventional fluorescent lighting fixture.

BACKGROUND

Fluorescent tube lights are widely used in a variety of locations, such as schools and office buildings. Although conventional fluorescent bulbs have certain advantages over, for example, incandescent lights, they also pose certain disadvantages including, inter alia, disposal problems due to the presence of toxic materials within the glass tube.

LED-based tube lights, which can be used as one-for-one replacements for fluorescent tube lights, have appeared in recent years. One such LED-based replacement light includes LEDs mounted on an elongated circuit board in a semi-cylindrical housing. A U-shaped lens can snap onto the housing to cover and disperse light from the LEDs. The replacement light can include two end caps, where an end cap is dispersed at each longitudinal end of the tube. The end caps generally include a molded plastic cup-shaped body that slides over the end of the tube to secure the end cap to the tube. Additionally, each end cap can include one or more connector pins for electrically and/or mechanically connecting the replacement light with standard fluorescent fixtures. For example, many end caps carry two connector pins for compatibility with fixtures designed to receive standard-sized tubes, such as T5, T8, or T12 tubes.

SUMMARY

Embodiments of an LED-based light for replacing a fluorescent bulb in a conventional fluorescent light fixture are disclosed herein. In one embodiment, the LED-based light includes a housing having a first end opposing a second end, a circuit board disposed within the housing and extending along a longitudinal axis of the housing, at least one LED mounted to the circuit board, and at least one end cap disposed on one of the first and second ends of the housing. The end cap includes at least one electrically conductive pin configured for physical and electrical connection to the light fixture. Circuitry is configured to provide a current path between the at least one LED and the at least one electrically conductive pin, and a switch included in the end cap is configured to selectively disconnect the current path.

In another embodiment, the LED-based light includes a housing having a first end opposing a second end, a circuit board disposed within the housing and extending along a longitudinal axis of the housing, at least one LED mounted to the circuit board, and at least one end cap disposed on one of the first and second ends of the housing. The end cap includes at least one electrically conductive pin configured for physical and electrical connection to the light fixture. A pin cover composed of an insulating material is adjacent to the first end and configured to selectively expose and substantially enclose the electrically conductive pin.

Embodiments of a method of installing an LED-based light into a conventional fluorescent light fixture, the LED-based light including a housing having a first end opposing a second end, at least one LED disposed within the housing, a first end cap disposed on the first end of the housing including at least one electrically conductive pin, a second end cap disposed on the second end of the housing including at least one electrically conductive pin, circuitry providing a current path between the first and second end cap's electrically conductive pins, and a switch, are also disclosed herein. The method includes engaging the switch in a first position to disconnect the current path, positioning the first and second end cap's at least one electrically conductive pin into the light fixture, and engaging the switch in a second position to connect the current path.

These and other embodiments will be described in additional detail below.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
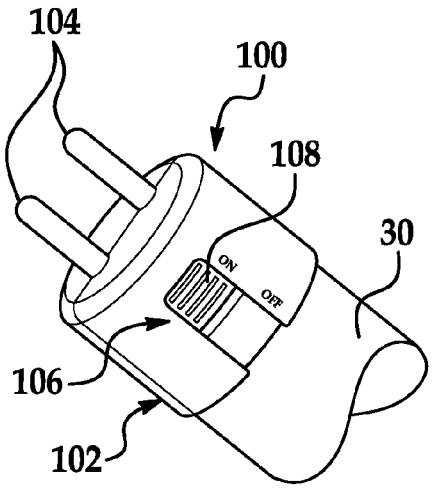
FIG. 1 is a partial perspective view of a LED-based replacement light in accordance with a first embodiment of the invention.

One problem when replacing a fluorescent lamp with a LED-based replacement light is the potential for contact with the exposed connector pins during, for example, installation or relamping. Some lamps, such as fluorescent lamps and their replacements, are automatically prepared to conduct upon installation. Accordingly, if the lighting fixture is energized when one end of the lamp is plugged into the fixture, it is possible that electrical current may flow through the body of the person installing the lamp to ground. Specifically, if one or more pins are exposed while at least one other pin is in electrical contact with the fixture, the person may experience electrical shock if they come in contact with the pins.

Embodiments of the present invention reduce or eliminate the shock hazard potential present in LED-based lights having exposed connector pins. FIGS. 1-25 illustrate these embodiments, which are LED-based replacement lights for replacing a conventional fluorescent light bulb in a fluorescent light fixture (not shown). The light fixture can be designed to accept standard fluorescent tubes, such as a T5, T8, or T12 fluorescent tube, or other standard sized lights, such as incandescent bulbs. Alternatively, the fixture can be designed to accept non-standard sized lights, such as lights installed by an electrician.

Each of the disclosed embodiments generally includes a circuit board (not shown), multiple LEDs (not shown) and a housing 30 at least partially defined by a high-dielectric translucent portion. The disclosed embodiments further include a pair of end caps with associated connector pins, which will be discussed in detail below.

The housing 30, as shown in the embodiments of FIGS. 1-22, is a light transmitting cylindrical tube. The housing 30 can be made from polycarbonate, acrylic, glass or another light transmitting material (i.e., the housing 30 can be transparent or translucent). For example, a translucent housing 30 can be made from a composite, such as polycarbonate with particles of a light refracting material interspersed in the polycarbonate. While the illustrated housing 30 is cylindrical, housings having a square, triangular, polygonal, or other cross sectional shape can alternatively be used. Similarly, while the illustrated housing 30 is linear, housings having an alternative shape, e.g., a U-shape or a circular shape can alternatively be used. Additionally, the housing 30 need not be a single piece. Instead, the housing 30 can be formed by attaching multiple individual parts, not all of which need be light transmitting. For example, a housing 30 can include an opaque lower portion and a lens or other transparent cover attached to the lower portion to cover the LEDs. The housing 30 can be manufactured to include light diffusing or refracting properties, such as by surface roughening or applying a diffusing film to the housing 30. For compatibility with the light fixture as discussed above, the housing 30 can have any suitable length. For example, the light may be approximately 48" long, and the housing 30 can have a 0.625", 1.0", or 1.5" diameter.

The circuit board can be an elongated printed circuit board. Multiple circuit board sections can be joined by bridge connectors to create the circuit board. The circuit board can be slidably engaged with the housing 30, though the circuit board can alternatively be clipped, adhered, snap- or friction-fit, screwed or otherwise connected to the housing 30. For example, the circuit board can be mounted on a heat sink that is attached to the housing 30. Also, any other type of circuit board may be used, such as a metal core circuit board. Alternatively, instead of a circuit board, other types of electrical connections (e.g., wires) can be used to electrically connect the LEDs to a power source.

The LEDs can be surface-mount devices of a type available from Nichia, though other types of LEDs can alternatively be used. For example, one or more organic LEDs can be used in place of or in addition to the surface-mount LEDs. The LEDs can be mounted to the circuit board by solder, a snap-fit connection, or other means. The LEDs can produce white light. However, LEDs that produce blue light, ultra-violet light or other wavelengths of light can be used in place of white light emitting LEDs.

The number of LEDs can be a function of the desired power of the light and the power of the LEDs. For a 48" light, for example, the number of LEDs can vary from about five to four hundred such that the light outputs approximately 500 to 3,000 lumens. However, a different number of LEDs can alternatively be used, and the light can output a different amount of lumens. The LEDs can be evenly spaced along the circuit board, and the spacing of the LEDs can be determined based on, for example, the light distribution of each LED and the number of LEDs. Alternatively, a single or multiple LEDs can be located at one or both ends of the light.

While the light can be compatible with standard sized fluorescent fixtures, an LED-based light having another shape, such as an incandescent bulb or another type of light, can alternatively be used. Also, other types of light sources, such as fluorescent or incandescent based light sources, can be used instead of or in addition to the LEDs.

FIG. 1 illustrates a light 100 in accordance with a first embodiment of the present invention. The light 100 can include two end caps 102 (only one end cap is shown in FIG. 1) with each end cap 102 carrying two electrically conductive pins 104 (i.e. bi-pin end caps). The pins 104 can be made of any type of electrically conductive material such as copper, aluminum, or other types of conductors. Each end cap 102 is located at a longitudinal end of the housing 30 for physically and electrically connecting the light 100 to the fixture. The end caps 102 can be made of any suitable material such as thermoplastic, thermoset or other types of insulators.

The end caps 102 can be the sole physical connection between the light 100 and the fixture. The end caps 102 can also be electrically connected to the circuit board to provide power to the LEDs. Although each end cap 102 is shown as including two pins 104, one or two of the total four pins that are located on both ends of the housing 30 can be "dummy pins" that do not provide an electrical connection. Alternatively, other types of electrical connectors can be used, such as an end cap carrying a single pin. Also, while the end caps 102 are shown as including cup-shaped bodies, the end caps 102 can have a different configuration (e.g., the end caps 102 can be shaped to be press fit into the housing 30). One or both of the end caps 102 can additionally include electric components, such as a rectifier and filter.

Circuitry can provide a current path in the light 100. The current path can be between the ends of the light 100, for example between one or more pins 104 of the end caps 102. The current path can include one or more pins 104 of the end cap 102, LEDs, the circuit board or wires, or any suitable combination thereof. For example, the current path can be between a pin 104 and the LEDs, between a pin 104 and the circuit board, or between the LEDs and the circuit board. One or both of the end caps 102 include a switch 106 that can selectively disconnect the current path. The switch 106 includes a sliding button 108 that can be selectively engaged between an "ON" position and an "OFF" position. The current path is disconnected when the button 108 is slid into the "OFF" position and is connected when the button 108 is slid into the "ON" position. Before the light 100 is installed in a light fixture, the switch 106 can be set (e.g., by the manufacturer or the installer) to the "OFF" position such that an open circuit condition exists, for example, between the ends of the tube. While the switch 106 is shown as a manual slide switch, any other suitable switch may be used. For example, in some embodiments the switch may be a push-button switch or a toggle switch. Additionally, the switch 106 may be labeled to warn the user not to energize the lamp (i.e. set the switch to "ON") until the lamp is fully installed. The label may be placed such that it must be removed before energizing the switch.

The switch 106 can break a current path at any point in the circuitry of the light 100. For example, one end of the switch 106 can be connected to the pins 104 of one of the end caps 102 and the other end of the switch 106 can be connected to the circuit board. Accordingly, when the switch 106 is in the "OFF" position, there will be no current flowing from the circuit board to the pins 104 and vice versa. However, the switch can be connected in any suitable manner to create the open circuit condition within light 100. As one example, the switch can break the current path between two series-connected LEDs.

When the installer places one end of the tube into an energized fixture and when the switch 106 is in the "OFF" position, the installer can remove or reduce the risk of shock if he comes into contact with the pins 104 by ensuring that the button 108 of the switch 106 is in the "OFF" position. Accordingly, as discussed previously, there will be no current flowing to the pins 104. Once the installer places both ends of the tube into the fixtures, the installer can then move the switch 106 from "OFF" to "ON" thereby reestablishing a closed circuit connection between the ends of the tube (i.e. permitting current to flow through light 100). Likewise, when the installer decides that he would like to remove the light 100 from the fixture, the installer can move the switch from the "ON" to "OFF" position to establish the open circuit connection.

Figure 2:
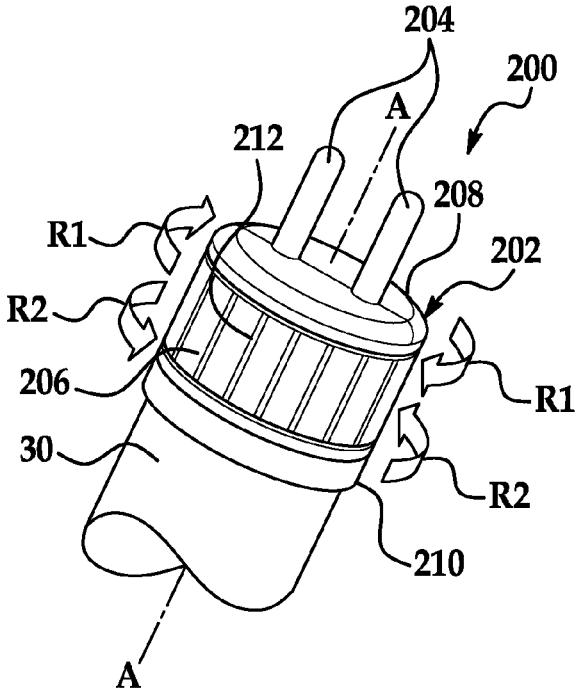
FIG. 2 is a partial perspective view of a LED-based replacement light in accordance with a second embodiment of the invention.

FIG. 2 illustrates a light 200 in accordance with a second embodiment of the present invention. The light 200 can include, similar to the first embodiment, two end caps 202 (only one end cap shown in FIG. 2) with each end cap 202 carrying two pins 204. One or both of the end caps 202 enable a feature similar to that described in connection with the first embodiment illustrated in FIG. 1. Specifically, the installer can break the current path at a point in the circuitry while the light is being installed or removed from the light fixture. However, rather than including the switch 106, the light 200 includes a rotatable collar 206 to actuate an internal switch (not shown) connected within the electrical circuitry of the light 200. The collar 206 can be rotatable about an axis A-A of the light 200. The collar 206 is rotated about the axis A-A in a first clockwise direction R1 to an "ON" position to actuate the switch and to create the closed circuit connection, where current can flow to the pins 204. The collar 206 can be rotated in a second counterclockwise direction R2 to an "OFF" position such that an open circuit condition exists and current no longer flows to the pins 204. Alternatively, in another embodiment the collar 206 can be rotated in the first direction R1 to an "OFF" position and rotated in second direction R2 to an "ON" position if desired.

The collar 206 circumferentially extends around and is rotatable about the end cap 202. Although the collar 206 is shown in FIG. 2 as extending from just below a top end 208 of end cap 202 to just above a bottom end 210 of end cap 202, the collar may be located in a different position as well. For example, the collar can be limited to a portion of the midsection of the end cap 202.

The collar 206 also includes an outer knurled surface 212. Alternatively, the collar 206 may include another suitable gripping contour, or may not include any gripping contour at all. In other embodiments, the collar may include a protrusion that aids a user in grasping the collar. The protrusion may be used in conjunction with an "ON" indicator for signifying when the switch has been actuated and an "OFF" indicator for signifying when the switch has not been actuated.

Similar to the first embodiment, when the installer places one end of the tube 30 into an energized fixture, the installer can remove or reduce the risk of shock if he comes into contact with the pins 204 by rotating the collar 206 after both ends of the light 200 have been placed into the fixture.

Figure 3A:
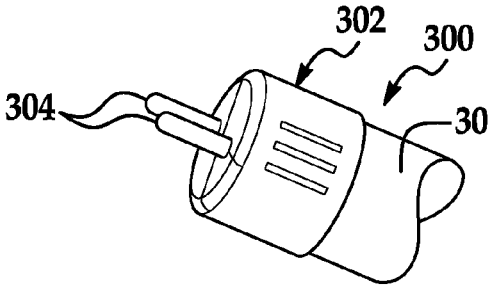
FIGS. 3A and 3B are partial perspective views of a LED-based replacement light in accordance with a third embodiment of the invention.
Figure 3B:
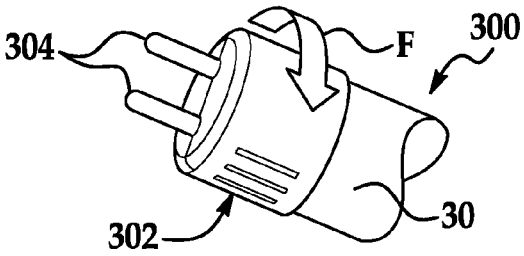

FIGS. 3A and 3B illustrate a light 300 in accordance with a third embodiment of the present invention. The light 300 can include, similar to the first and second embodiments, two end caps 302 (only one end cap shown in FIGS. 3A and 3B) with each end cap 302 carrying two pins 304. One or both of end caps 302 enable a feature similar to that described in connection with the first and second embodiments illustrated in FIGS. 1 and 2, respectively. Specifically, the installer can break the current path in the light 300 at a point in the circuitry while the light is being installed or removed from the light fixture. However, rather than including the switch 106 or the collar 206, one or both end caps 302 can be rotated relative to housing 30 by a rotational force F exerted on the end cap 302 and/or the housing 30.

FIG. 3A illustrates the end cap 302 and pins 304 in a first position, before the end cap 302 and the pins 304 have been rotated. When in the first position as shown in FIG. 3A, the open circuit condition is created. To permit electrical current to flow through both ends of the tube, as illustrated in FIG. 3B, the end cap 302 can be rotated to a second position. The end cap 302 may be rotated about 90 degrees to the second position such that an internal switch (not shown) closes within the electrical circuitry of light 300. Of course, the end cap 302 can be rotated to any other suitable degree (e.g., 180 degrees). The end cap 302 also includes a retaining feature (not shown) that holds the end cap 302 in the "ON" position, where the retaining feature can be any device that secures the end cap 302 in the second position. As one example, the retaining feature is a biasing device that exerts a spring force to hold the end cap 302 in the second position.

Figure 4:
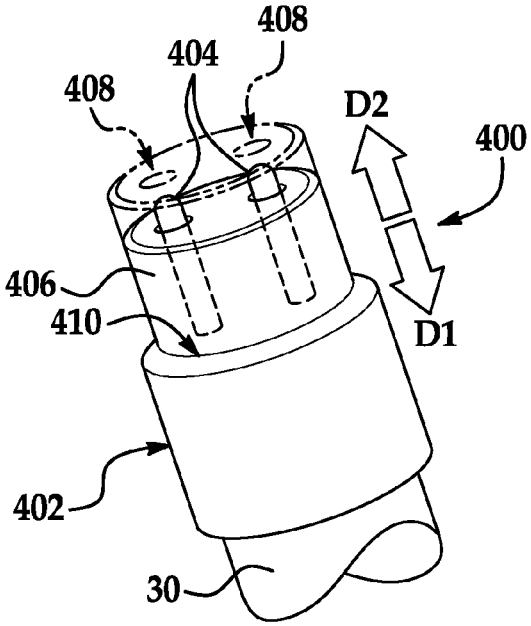
FIG. 4 is a partial perspective view of a LED-based replacement light in accordance with a fourth embodiment of the invention.

FIG. 4 illustrates a light 400 in accordance with a fourth embodiment of the present invention. The light 400 can include two end caps 402 (only one end cap shown in FIG. 4) with each end cap 402 carrying two pins 404. Each end cap 402 is at a longitudinal end of the housing 30, for physically and electrically connecting the light 400 to the fixture.

The light 400 also includes a pin cover 406 constructed from an insulating material such as, for example, a thermoplastic. As illustrated, the cover 406 has a cylindrical shape and is concentric with the housing 30 and the end cap 402. The cover 406 has an outer diameter that is slightly smaller than the outer diameter of housing 30. However, the pin cover can also include a number of different shapes and sizes to cover pins 404.

The cover 406 can be attached to a spring or other type of biasing mechanism (not shown) located within the tube 30, and allows the cover 406 to retract into the end cap 402 in a first direction D1 when a force is exerted, and correspondingly allows the cover 406 to travel in a second direction D2 to a protracted position (illustrated in phantom line) when the force is no longer applied to the end cap 402. The cover 406, when in the protracted position, covers the pins 406 before the light 400 is installed. The cover 406 can telescope within the end cap 402 during installation. Specifically, when the installer installs one of the ends of the light tube 400 into the fixture, the force exerted by pressing the respective end of the light tube 400 into the fixture urges the cover 406 in the first direction D1 which axially retracts the pin cover 406 into the end cap 402.

Accordingly, after a force has been applied to the cover 406, the pins 404 can be exposed through apertures 408 in the cover 406. The apertures 408 can be sized to pass the pins 404, but can be sized to not permit other objects to pass. For example, the apertures can have a 0.25" diameter such that the installer's fingers or tools cannot pass through. It follows that the cover 406 protects the installer from coming into contact with the pins 404 and can avoid any possible electrical shock.

Figure 5:
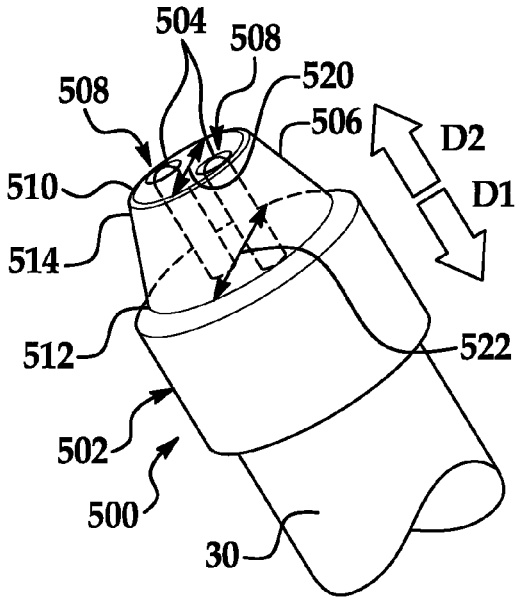
FIG. 5 is a partial perspective view of a LED-based replacement light in accordance with a fifth embodiment of the invention.

FIG. 5 illustrates a light 500 in accordance with a fifth embodiment of the present invention. The light 500 can include, similar to the fourth embodiment, two end caps 502 (only one end cap shown in FIG. 5) with each end cap 502 carrying two pins 504, and a pin cover 506. Like the fourth embodiment, the pin cover 506 has two apertures 508. The cover 506 covers the pins before installation and is able to telescope within end cap 502 when a force is exerted by the installer during installation. However, unlike the fourth embodiment, the pin cover 506 is tapered, where a first end 510 of the cover 506 gradually and outwardly ramps to a second end 512. In other words, as illustrated in FIG. 5, a first diameter 520 of the first end 510 is smaller than a second diameter 522 of the second end 512. The radial insertion of the light 500 into the fixture causes the cover 506 to press against an end of the fixture, thereby urging the cover 506 to retract within the end cap 502.

Similar to the fourth embodiment, the cover 506 is attached to a spring or biasing element (not shown) that causes the pin cover 506 to retract, as discussed previously. Specifically, the end cap 502 is retractable in a first direction D1 when a force is exerted, and the cover 506 travels in a second direction D2 to a protracted position when the force is no longer applied to the end cap 502. The pins 504 can be exposed through apertures 508 in the cover 506, where the apertures 508 are sized to pass the pins 504, but can be sized not to permit other objects to pass. It follows that the cover 506 protects the installer from coming into contact with the pins 504 and can avoid any possible electrical shock.

Figure 6:
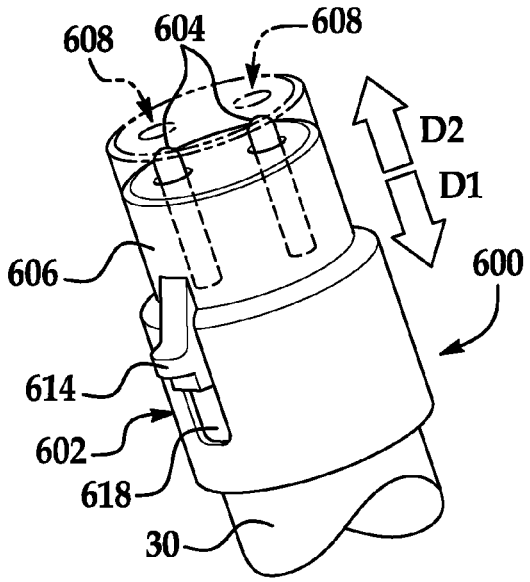
FIG. 6 is a partial perspective view of a LED-based replacement light in accordance with a sixth embodiment of the invention.

FIG. 6 illustrates a light 600 in accordance with a sixth embodiment of the present invention. The light 600 can include, similar to the fourth embodiment, two end caps 602 (only one end cap shown in FIG. 6) with each end cap 602 carrying two pins 604 and a pin cover 606. Like the fourth embodiment, the pin cover 606 has two apertures 608. The pin cover 606 has a cylindrical shape and is concentric with the housing 30 and the end cap 602. The cover 606 covers the pins 604 before installation and telescopes within the end cap 602 when a force is exerted by the installer during installation. However, unlike the fourth embodiment, a manual slide lever 614 is included and is slidable within a groove 618, which enables the cover 606 to move within the end cap 602 in the first direction D1 and the second direction D2.

The lever 614 can be attached either directly or indirectly to the cover 606 such that when the lever 614 is moved in the first direction D1, the lever 614 forces the cover 606 to retract into the end cap 602. When the lever 614 is moved in the second direction D2, the lever 614 urges the cover 606 out of the end cap 602, causing the cover 606 to protract. The lever 614 can be located in a position relative to the pins 604 such that the installer's fingers are unlikely to come in contact with the pins 604 when the cover 606 is retracted. In alternative embodiments, a button, knob or other suitable device can be used in lieu of lever 614.

Figure 7:
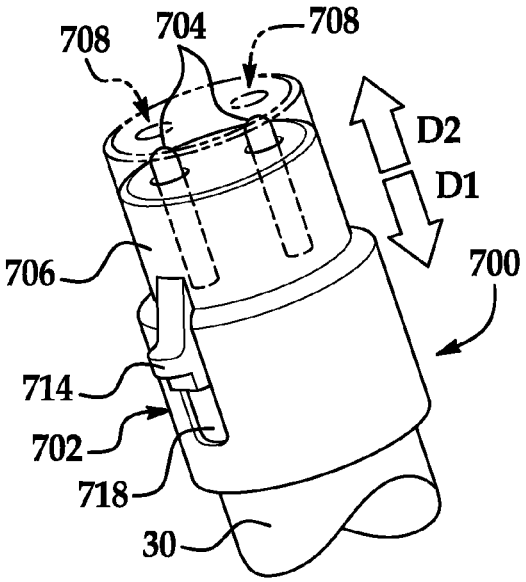
FIG. 7 is a partial perspective view of a LED-based replacement light in accordance with a seventh embodiment of the invention.

FIG. 7 illustrates a light 700 in accordance with a seventh embodiment of the present invention. The light 700 can include, similar to the sixth embodiment, two end caps 702 (only one end cap shown in FIG. 7) with each end cap 702 carrying two pins 704 and a pin cover 706 having two apertures 708. Like the sixth embodiment, the cover 706 covers the pins before installation and telescopes within the end cap 702 using a manual slide lever 714 that is slidable within a groove 718. The lever 714 allows the cover 706 to move within the end cap 702 in the first direction D1 and the second direction D2. However, unlike the sixth embodiment, the lever 714 can include a locking mechanism (not shown) that can prevent or permit retraction of the cover 706.

For example, the locking mechanism can prevent the cover 706 from retracting into the end cap 702 when the locking mechanism is in a locked (i.e. latched) position. The locking mechanism can be locked or latched when, for example, there is no force exerted to inwardly press the lever 714 (i.e. by the installer). The locking mechanism permits the cover 706 to retract into the end cap 702 when the locking mechanism is in an unlocked (i.e. unlatched) position. The locking mechanism can be unlocked or unlatched, when, for example, the installer exerts a force to inwardly press the lever 714. The locking mechanism is any type of device that can selectively prevent the lever 714 from sliding within the groove 718, and can include a variety of mechanisms such as, for example, a latch, a pin, or a spring (all not shown).

In one embodiment of the locking mechanism, when the cover 706 is in the protracted position and the locking mechanism is in the latched position, the locking mechanism includes a spring and a pin that can engage with a latch. To remove the pin from the latch, the installer can inwardly press and hold the lever 714, which causes the locking mechanism to release the pin. Accordingly, the installer can (while simultaneously pressing the lever 714), move the lever 714 in the first direction D1, which permits the cover 706 to retract within end cap 702 or within the second direction D2, which permits the cover 706 to protract from within end cap 702. Of course, other locking mechanisms are available that can be used instead of or in addition to the locking mechanism described above.

Figure 8:
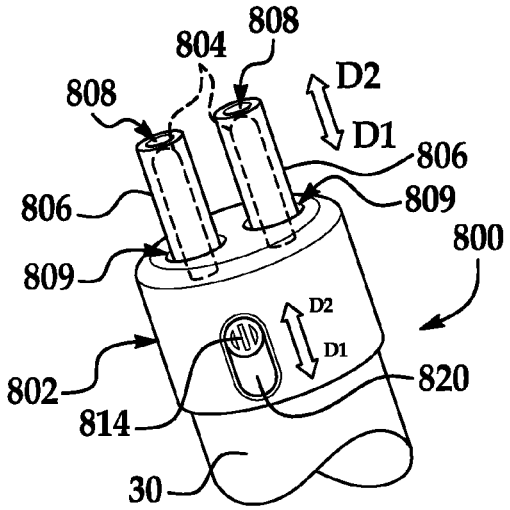
FIG. 8 is a partial perspective view of a LED-based replacement light in accordance with an eighth embodiment of the invention.

FIG. 8 illustrates a light 800 in accordance with an eighth embodiment of the present invention. The light 800 can include, similar to the sixth embodiment, two end caps 802 (only one end cap shown in FIG. 8). Each end cap 802 has two pins 804 extending therethrough. Unlike the sixth embodiment where the cover 606 is concentric with, for example, the tube 30, the light 800 includes and a separate pin cover 806 for each pin 804. Each pin cover 806 covers the pins 804 before instillation. In this embodiment, however, each pin cover 806 can telescope within a respective aperture of 809 of end cap 802 when a force is exerted by the installer during installation.

A manual slide button 814 slidable within a groove 820 enables the pin covers 806 to protract and retract into the end cap 802. Similar to the sixth embodiment, the button 814 can be engaged directly or indirectly with covers 806 such that when the button 814 is moved in the first direction D1 the covers 806 retract into the end cap 802. When the button 814 is moved in the second direction D2, the covers 806 protract from the end cap 802.

Figure 9:
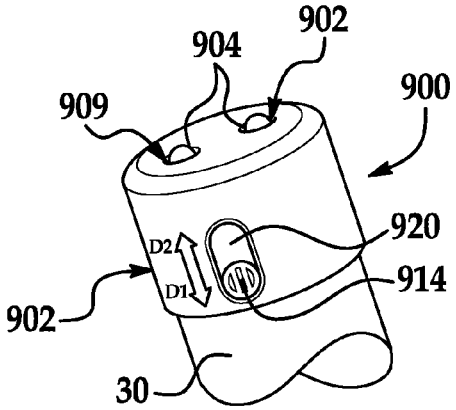
FIG. 9 is a partial perspective view of a LED-based replacement light in accordance with a ninth embodiment of the invention.

FIG. 9 illustrates a light 900 in accordance with a ninth embodiment of the present invention. The light 900 can include, similar to the eighth embodiment, two end caps 902 (only one end cap shown in FIG. 9). Each end cap 902 has two pins 904 extending therethrough. FIG. 9 illustrates the pins 904 retracted into a respective aperture 909 of the end cap 902. Unlike the eighth embodiment, which includes pin covers 806, the light 900 includes an extension mechanism (not shown) which causes the pins 904 protract and retract into the respective aperture 909. In one embodiment, at least a portion of the aperture 909 where the pins 904 retract into is constructed of a dielectric material, however, other types material can be used as well.

A manual slide button 914 slidable within a groove 920 enables the pins 904 to protract and retract. The button 914 can be engaged directly or indirectly with pins 904 such that when the button 914 is moved in the first direction D1, the pins 904 retract into the end cap 902, and when the button 914 is moved in the second direction D2 the pins 904 protract from the end cap 902. The pins 904 can be in the retracted position when received by the manufacturer, or can be moved into the retracted position before installation into a lighting fixture by an installer. When the installer installs one or both the ends of the light tube 900 into the fixture, the installer can move the manual slide button 914 to the second position D2, thereby protracting the pins 904 from the end cap 902. Once the pins 904 have been protracted from the end cap 902 and are exposed, the pins 904 can be in electrical communication with the lighting fixture. Similarly, when the installer wants to remove the light tube 900, the button 914 is moved in the first direction D1 to retract the pins 904 before removing the light tube 900 from the fixture. Although a manual slide button is illustrated, a different device (e.g. manual slide lever) may be used as well. Alternatively, a spring-loaded device including an elastic element may be used instead to protract or retract the pins.

Figure 10:
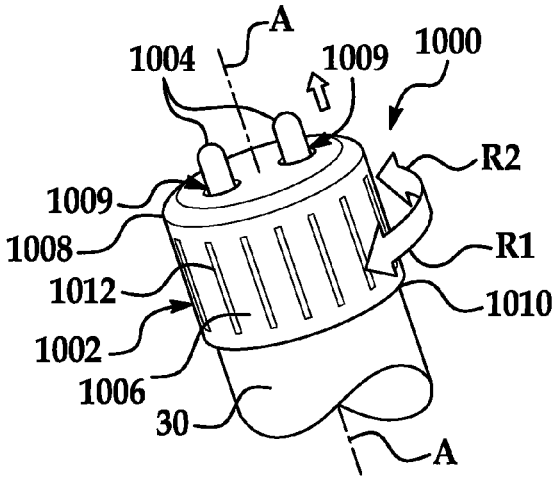
FIG. 10 is a partial perspective view of a LED-based replacement light in accordance with a tenth embodiment of the invention.

FIG. 10 illustrates a light 1000 in accordance with a tenth embodiment of the present invention. The light 1000 can include, similar to the eighth and ninth embodiments, two end caps 1002 (only one end cap shown in FIG. 10). Each end cap 1002 can have two pins 1004 extending therethrough. Instead of a slide lever or button as described in previous embodiments, the light 100 includes a rotatable collar 1006 that is generally circular for protracting and retracting pins 1004 into respective apertures 1009. The collar 1006 circumferentially extends around and is rotatable about the end cap 1002. Although the collar 1006 is shown in FIG. 10 as extending from just below a top end 1008 of the end cap 1002 to just above a bottom end 1010 of the end cap 1002, the collar 1006 may be located in a different position as well. For example, the collar can be limited to a portion of the mid-section of the end cap 1002. In another embodiment, the collar 1006 is integrated with the end cap 1002.

The collar 1006 also includes an outer knurled surface 1012. Alternatively, the collar 1006 may include another suitable gripping contour, or may not include any gripping contour at all. In other embodiments, the collar may include a protrusion that aids a user in grasping the collar 1006.

The collar 1006 is rotatable about a longitudinal axis A-A of the light 1000. The collar 1006 is rotated about the axis A-A in a first clockwise direction R1 permitting the pins 1004 to protract from the respective aperture 1009 of the end cap 1002. When the collar 1006 is rotated in a second counter-clockwise direction R2 the pins 1004 can be retracted in the respective apertures 1009 of the end cap 1002. Alternatively, in another embodiment the collar 1006 can be rotated in the first direction R1 to retract the pins 1004 and rotated in the second direction R2 to protract the pins 1004 if desired.

Figure 11A:
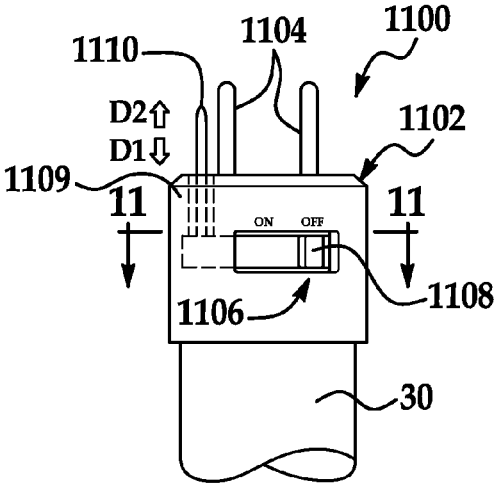
FIGS. 11A, 11B and 11C are a partial perspective view of a LED-based replacement light and the internal circuitry located within the light in accordance with an eleventh embodiment of the invention.
Figure 11B:
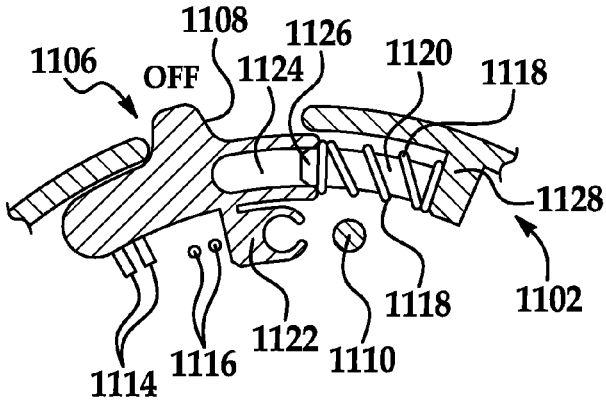
Figure 11C:
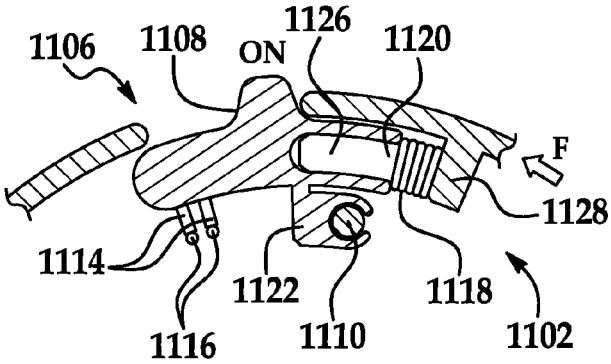

FIGS. 11A-11C illustrate a light 1100 in accordance with an eleventh embodiment of the present invention. Referring to FIG. 11A, the light 1100 can include two end caps 1102 (only one end cap shown in FIG. 11). Each end cap 1102 has two pins 1104 extending therethrough. One or both of the end caps 1102 include a feature where the installer can break the current path at a point in the circuitry while the light 1100 is being installed or removed from the light fixture. One or both of the end caps 1102 include a switch 1106 that cooperates with a moveable pin 1110 for connecting and disconnecting a current path between the ends of the light 1100. The switch 1106 includes a sliding button 1108 that can be slid between an "ON" position and an "OFF" position. The moveable pin 1110 is spring loaded by a biasing mechanism such as, for example, a coil spring. The moveable pin 1110 can be selectively protracted from and retracted into an aperture 1109 of the end cap 1102.

The current path is disconnected when the button 1108 is slid into the "OFF" position and/or the moveable pin 1110 is urged into the second direction D2, where the moveable pin 1110 is protracted from the aperture 1109 of the end cap 1102. The current path is connected when the button 1108 is slid into the "ON" position and the moveable pin 1110 is urged into the first direction D1, where the moveable pin 1110 is retracted into the aperture 1109 of the end cap 1102.

FIGS. 11B and 11C are a cross sectional view of the internal components located in the end cap 1102 for breaking the current path, where FIG. 11B is an illustration of the circuitry in the "OFF" position and FIG. 11C is an illustration in the "ON" position. The button 1108 includes one or more moveable contacts 1114 that are located within an interior of the end cap 1102 and can be brought into sliding contact with a set of stationary contacts 1116 for closing the circuit path. The sliding button 1108 includes an aperture 1124 for receiving a spring loaded pin 1120. The pin 1120 includes a biasing mechanism such as a coil spring 1118. The sliding button 1108 includes an aperture 1124 for receiving a first end 1126 of the pin 1120 and a latching mechanism 1122. The pin 1120 includes a second end 1128 that is connected to the end cap 1102. The latching mechanism 1122 is a generally hook-shaped member, however the latching mechanism 1122 can be any mechanism suitable for engagement with the moveable pin 1110.

Referring to FIGS. 11A-11C, before the lamp 1100 is installed, the button 1108 is in the "OFF" position and the latching mechanism 1122 is not connected to the moveable pin 1110. When the installer places an end of the light 1100 into an energized fixture, the moveable pin 1110 contacts a fixture connector such that the moveable pin 1110 is depressed in the first direction D1 into the aperture 1109 of the end cap 1102. The installer slides the button 1108 to the "ON" position, thereby compressing the spring 1118 and the moveable pin 1110 engages with the latching mechanism 1122. The contacts 1114 located on the button 1108 are brought into contact with the stationary contacts 1116, thereby closing the circuit, and allowing current to flow to the pins 1104. When the lamp 1100 is removed from the fixture, the moveable pin 1110 protracts from the end cap 1102 and disengages from the latching mechanism 1122. The button 1108 is urged into the "OFF" position by a biasing force F exerted by the compressed spring 1118, and the contacts 1114 and 1116 are no longer in electrical communication with one another, thereby opening the circuit.

Figure 12:
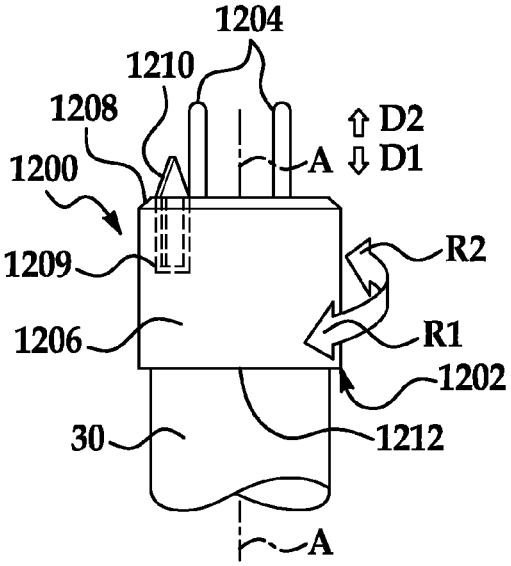
FIG. 12 is a partial perspective view of a LED-based replacement light in accordance with a twelfth embodiment of the invention.

FIG. 12 illustrates a light 1200 in accordance with a twelfth embodiment of the present invention. The light 1200 can include, similar to the eleventh embodiment, two end caps 1202 (only one end cap shown in FIG. 12). Each end cap 1202 can have two pins 1204 extending therethrough, and a moveable pin 1210, and includes similar internal circuitry illustrated in FIGS. 11B-11C. However, instead of a slide lever or button as described in previous embodiments, the light 1200 includes a rotatable collar 1206 of circular shape for protracting and retracting the moveable pin 1210 into a respective aperture 1209. The collar 1206 circumferentially extends around and is rotatable about the end cap 1202. Although the collar 1206 is shown in FIG. 12 as extending from just below a top end 1208 of the end cap 1202 to just above a bottom end 1212 of the end cap 1202, the collar 1206 may be located in a different position as well. For example, the collar can be limited to a portion of the mid-section of the end cap 1202. In another embodiment, the collar 1206 is integrated with the end cap 1202.

Although not illustrated, the collar 1206 may include an outer knurled surface that provides a textured surface that is easier for a user to grasp. Alternatively, another suitable gripping contour may be provided as well. The collar 1206 is rotatable about a longitudinal axis A-A of the light 1200. The collar 1206, instead of sliding button 1108 illustrated in the eleventh embodiment, acts as a switch to move the internal circuitry of the light 1200 between an "ON" position and an "OFF" position. The collar 1206 is rotated about the axis A-A in a first clockwise direction R1 to the "ON" position and is rotated in a second counterclockwise direction R2 to the "OFF" position. Alternatively, in another embodiment the collar 1206 can be rotated in the first direction R1 to the "OFF" position and rotated in the second direction R2 to the "ON" position if desired.

When the installer places an end of the light 1200 into an energized fixture, the moveable pin 1210 contacts a fixture connector such that the moveable pin 1210 is depressed in the first direction D1 into the aperture 1209 of the end cap 1202. Similar to the eleventh embodiment illustrated in FIGS. 11B-11C, the moveable pin 1210 engages with a latching mechanism located within an interior of the end cap 1202. The installer then rotates the collar 1206 to the "ON" position. The internal circuitry of the light 1200 is then closed, allowing current to flow to the pins 1204. When the lamp 1200 is removed from the fixture, the moveable pin 1210 protracts from the end cap 1102 and disengages from the latching mechanism. The collar 1206 may be rotated about the axis A-A to the "OFF" position by a biasing force exerted by a spring located within the end cap 1202 (similar to the spring 1118 illustrated in FIGS. 11B-11C), thereby opening the circuit.

Figure 13:
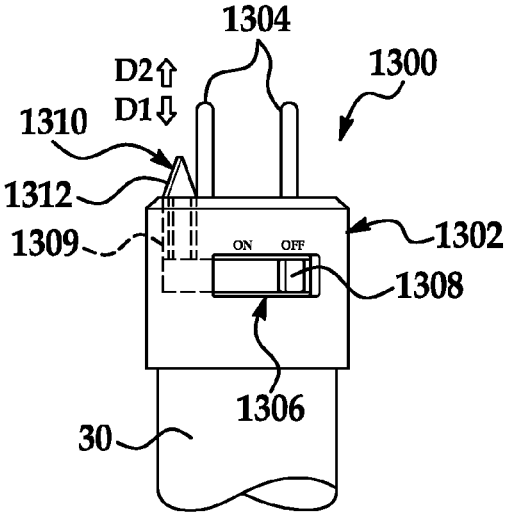
FIG. 13 is a partial perspective view of a LED-based replacement light in accordance with a thirteenth embodiment of the invention.

FIG. 13 illustrates a light 1300 in accordance with a thirteenth embodiment of the present invention. The light 1300 can include, similar to the eleventh embodiment, two end caps 1302 (only one end cap shown in FIG. 13). Each end cap 1302 can have two pins 1304 extending therethrough and a moveable pin 1310. The light 1300 includes a feature similar to the embodiment illustrated in FIGS. 11A-11C where the installer can break the current path at a point in the circuitry, and includes a switch 1306 that cooperates with the moveable pin 1310 for selectively disconnecting a current path between the ends of the light 1300. The switch 1306 includes a sliding button 1308 that can be slid between an "ON" position and an "OFF" position, and the moveable pin 1310 can be selectively protracted from and retracted into an aperture 1309 of the end cap 1302. However, unlike the eleventh embodiment, the moveable pin 1310 includes an outer surface 1312 with sloped or ramped sides to facilitate placing the moveable pin 1310 into the aperture 1309. Specifically, the sloped outer surface 1312 provides more surface area contact with the lighting fixture than a straight pin, especially when the light 1300 is installed at an angle.

The exposed portion of the outer surface 1312 of the moveable pin 1310 includes a generally triangular or pointed profile when protracted from the end cap 1302. When the installer places an end of the light 1300 into an energized fixture, the sloped outer surface 1312 of the moveable pin 1310 contacts a fixture connector such that the moveable pin 1310 is depressed in the first direction D1 and into the aperture 1309 of the end cap 1302, thereby closing the circuitry located within the light 1300. When the lamp 1300 is removed from the fixture, the moveable pin 1310 protracts from the end cap 1302 in the second direction, thereby opening the circuit.

Figure 14:
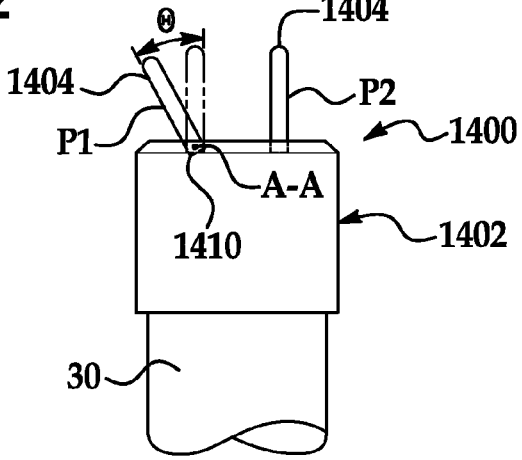
FIG. 14 is a partial perspective view of a LED-based replacement light in accordance with a fourteenth embodiment of the invention.

FIG. 14 illustrates a light 1400 in accordance with a fourteenth embodiment of the present invention. The light 1400 can include two end caps 1402 (only one end cap shown in FIG. 14) with each end cap 1402 carrying two pins 1404. One or both the pins 1404 are rotatable about an axis A-A between a first position P1 (shown on the left pin 1404) and a second position P2 (shown on the right pin 1404). The pin 1404 is rotatable about the axis A-A at a predetermined angle θ. As illustrated in FIG. 14 the angle θ is about 30 degrees, however it is understood that the angle θ may be any other suitable angle (e.g., 15 degrees).

When in the first position P1, an open circuit condition is created. The pin 1404 can be rotated about the axis A-A to the second position P2 to close the circuit, thereby allowing current to flow to the pin 1404. Specifically, a bottom end 1410 of the pin 1404 contacts an electrical contact (not shown) located in the end cap 1402 when the pin 1404 is upright and in the second position P2, thereby allowing current to flow in the light 1400. When the pin 1404 is rotated about the axis A-A to the first position P1, the bottom end 1410 of the pin 1404 moves away from and no longer makes contact with the electrical contact, thereby opening the circuit. Although an electrical contact is discussed, the bottom end 1410 of the pin 1404 may also contact a switch actuator to open and close the circuitry of the light 1400 as well.

At least one of the pins 1404 is set to the first position P1 when the installer places an end of the light 1400 into an energized fixture. The fixture connector makes contact with the pin 1404 such that the pin 1404 rotates about the axis A-A at the angle θ and into the second position P2, which closes the circuitry located within the light 1400 and allowing current to flow to the pins 1404. The lighting fixture holds the pins 1404 upright in the second position P2 until the light 1400 is removed from the fixture. When removed from the fixture, the pins 1404 rotate about the axis A-A back to the first position P1, where current can no longer flow to the pins 1404.

Figure 15A:
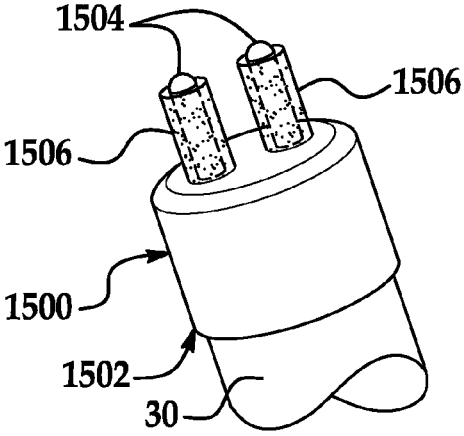
FIGS. 15A and 15B are a partial perspective view of a LED-based replacement light and a pin cover in accordance with a fifteenth embodiment of the invention.

FIG. 15A illustrates a light 1500 in accordance with a fifteenth embodiment of the present invention. The light 1500 can include two end caps 1502 (only one end cap shown in FIG. 15) with each end cap 1502 carrying two pins 1504. The pins 1504 each include a corresponding pin cover 1506 constructed from a resilient electrically insulating material such as, for example, an expandable foam. However, any electrically insulating material that is resilient enough to compress when the pins 1504 are inserted into a light fixture may be used as well. As illustrated, each of the pin covers 1506 have a generally cylindrical shape and are concentric with the respective pin 1504. When the light 1500 is installed in the lighting fixture, the pin covers 1506 are compressed as the pins 1504 are axially inserted into the lighting fixture, revealing the pins 1504. When the light 1500 is removed from the lighting fixture, the pin covers 1504 expand to cover each of the pins 1504.

Figure 15B:
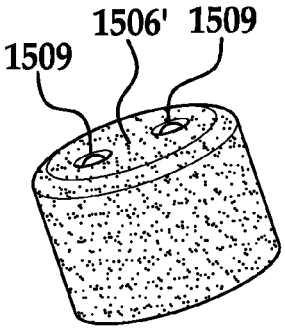

FIG. 15B is an alternative embodiment 1506' of the pin cover. In the embodiment as illustrated, the pin cover 1506' covers both of the pins 1504, and includes a generally cylindrical shape which is concentric with the housing 30 and the end cap 1502. The pin cover 1506' also includes two apertures 1509 for receiving each of the pins 1504. Similar to the embodiment in FIG. 15A, when the light is installed into the lighting fixture, the entire pin cover 1506' is compressed as the pins 1504 are axially inserted into the lighting fixture. The pin cover 1506' expands back to cover the pins 1504 when the light 1500 is removed from the lighting fixture.

Figure 16A:
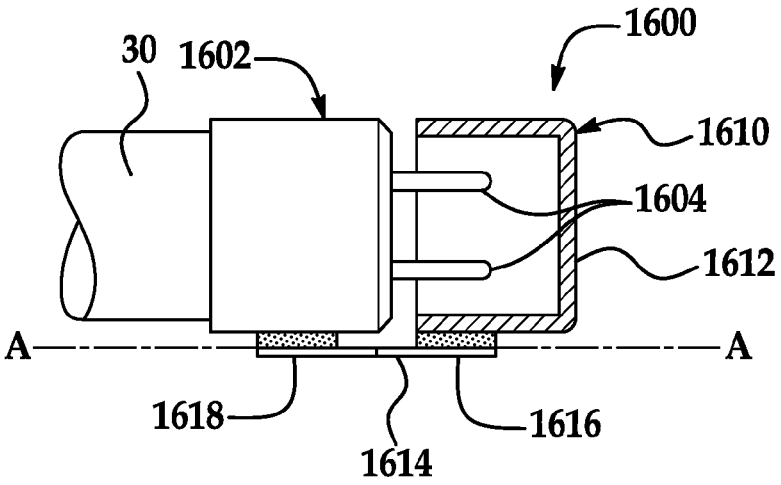
FIGS. 16A and 16B are partial perspective views of a LED-based replacement light in accordance with a sixteenth embodiment of the invention.
Figure 16B:
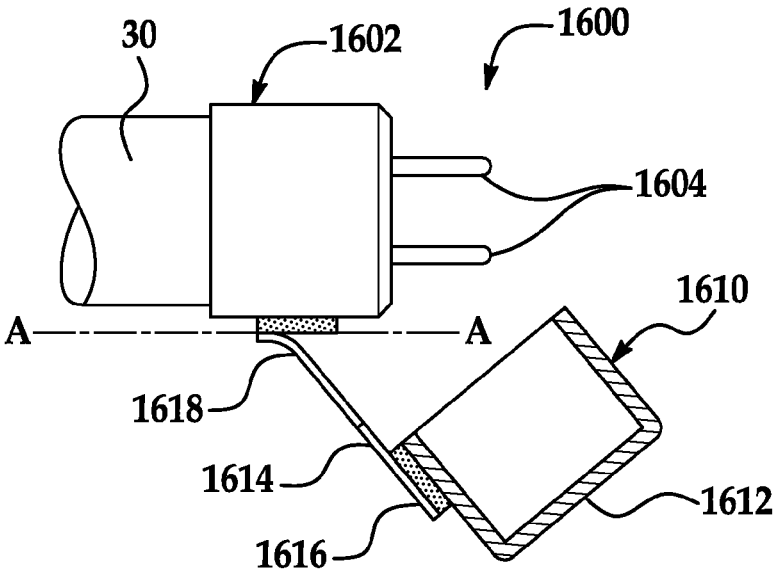

FIGS. 16A and 16B illustrate a light 1600 in accordance with a sixteenth embodiment of the present invention. The light 1600 can include, similar to the sixteenth embodiment, two end caps 1602 (only one end cap shown in FIG. 16). Each end cap 1602 has two pins 1604 extending therethrough. The light 1600 includes a covering assembly 1610 that covers the pins 1602, and is selectively rotatable about an end axis A-A end to reveal the pins 1604 when the light 1600 is placed in the lighting fixture.

The covering assembly 1610 includes a cover 1612 that is constructed from an insulating material such as, for example, a thermoplastic. The cover 1612 can be generally C-shaped to cover the pins 1602 and is held in place by a spring loaded connecting member 1614. The connecting member 1614 includes a first end 1616 and a second end 1618, where the connecting member 1614 is attached to the covering 1612 at the first end 1616 and to the end cap 1602 at the second end 1618. The connecting member 1614 is a spring loaded or other type of biased mechanism that rotates about the end axis A-A when the installer places the light tube 1600 into the fixture. Specifically, when the cover 1612 contacts the light fixture, the connecting member 1614 is rotated about the end axis A-A such that the connecting member 1614 springs into the position illustrated in FIG. 16B, thereby exposing the pins 1604. Once the pins 1604 are exposed, the pins 1604 can be in electrical communication with the lighting fixture. The lighting fixture can hold the cover 1612 in place to keep the pins 1604 exposed. Similarly, when the installer removes the light tube 1600, the connecting member 1614 is biased or spring loaded such that the connecting member 1614 springs back to the covered position as seen in FIG. 16A, as the lighting fixture no longer holds the cover 1612 in place.

Figure 17:
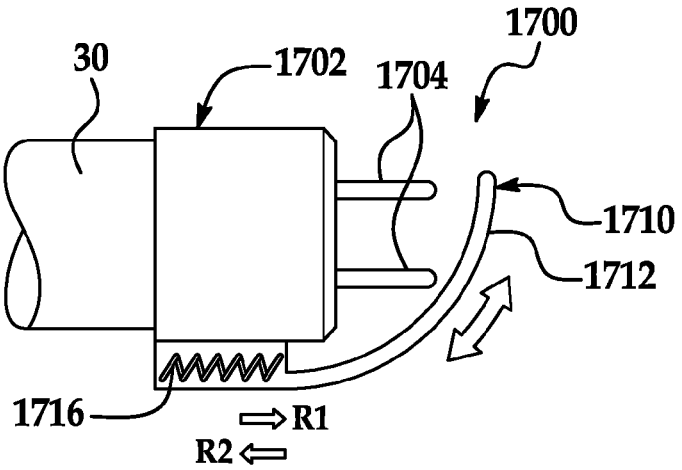
FIG. 17 is a partial perspective view of a LED-based replacement light in accordance with a seventeenth embodiment of the invention.

FIG. 17 illustrates a light 1700 in accordance with a seventeenth embodiment of the present invention. The light 1700 can include, similar to the sixteenth embodiment, two end caps 1702 (only one end cap shown in FIG. 17). Each end cap 1702 can have two pins 1704 extending therethrough and a covering 1710. The light 1700 includes a feature similar to the embodiment illustrated in FIGS. 16A and 16B where the covering assembly 1710 exposes the pins 1704 when the light 1700 is installed. However, unlike the sixteenth embodiment, the covering assembly 1710 includes a cover 1712 constructed from a resilient material that is biased to selectively curve over the pins 1704, and is slidable axially to retract and reveal the pins 1704 when the light 1700 is removed from the fixture.

The covering assembly 1710 may also include a biasing member 1716 such as, for example, a spring that assists the cover 1712 in springing into a closed position to cover the pins 1704. Specifically, when the cover 1712 contacts the light fixture, the cover 1712 springs into a retracted position, thereby exposing the pins 1704. Once the pins 1704 are exposed, the pins 1704 can be in electrical communication with the lighting fixture. The lighting fixture can hold the cover 1712 in place to keep the pins 1704 exposed. Similarly, when the installer removes the light tube 1700, the connecting member 1716 is biased or spring loaded such that the connecting member 1716 springs back to cover the pins 1704, as the lighting fixture no longer holds the cover 1712 in place. The biasing member 1716 is biased in a direction R1, and provides a biasing force that assists the cover 1712 in springing back to a closed position to cover the pins 1704. Alternatively, in another embodiment, the biasing member 1716 is biased in a second direction R2 that is opposite the first direction R1. In this alternative embodiment, the biasing member 1716 assists the cover 1712 in springing to an open position to reveal the pins 1704.

Figure 18A:
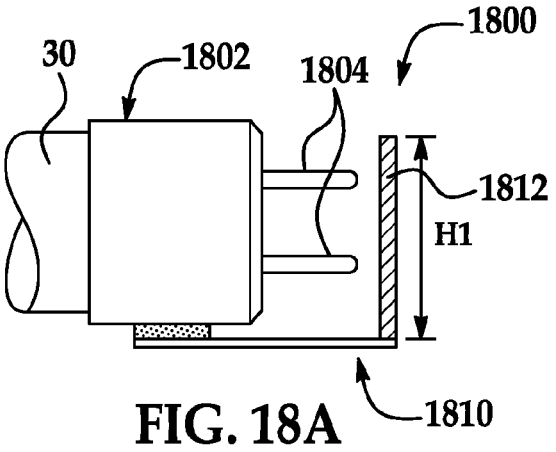
FIGS. 18A and 18B are partial perspective views of a LED-based replacement light in accordance with an eighteenth third embodiment of the invention.
Figure 18B:
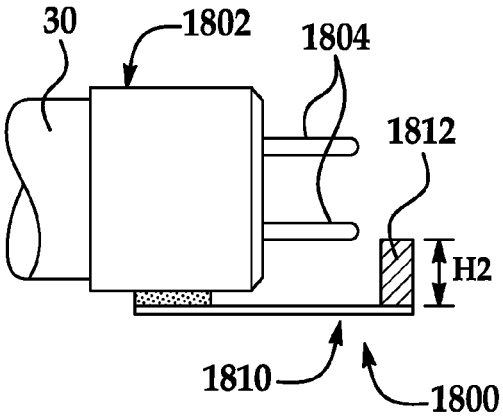

FIGS. 18A and 18B illustrate a light 1800 in accordance with an eighteenth embodiment of the present invention. The light 1800 can include, similar to the sixteenth and seventeenth embodiments, two end caps 1802 (only one end cap shown in FIGS. 18A-18B). Each end cap 1802 can have two pins 1804 extending therethrough and a covering assembly 1810. The light 1800 includes a feature similar to the sixteenth and seventeenth embodiments where the covering assembly 1810 exposes the pins 1804 when the light 1800 is installed. However, unlike the sixteenth and seventeenth embodiments, the covering assembly 1810 includes a cover 1812 that can expand and contract to different heights, thereby exposing the pins 1804. The cover 1812 can be constructed from a resilient insulating material. Alternatively, the cover 1812 can include a biasing member that is integrated with the cover 1812.

Referring the FIG. 18A, before contacting the light fixture, the cover 1812 covers the pins 1804 by remaining expanded at a first height H1. As the light 1800 is placed into the fixture, the cover 1812 makes contact with the fixture, thereby contracting the cover 1812 from the first height H1 to a second, smaller height H2 that is illustrated in FIG. 18B. When the cover 1812 is at the second height H2, the pins 1604 are exposed. Once the pins 1804 are exposed, the pins 1804 can be in electrical communication with the lighting fixture. The lighting fixture can hold the cover 1812 in place at the second height H2 to keep the pins 1804 exposed. Similarly, when the installer wants to remove the light tube 1800, the cover 1812 expands back to the first height H1, as the lighting fixture no longer holds the cover 1812 in place.

Figure 19A:
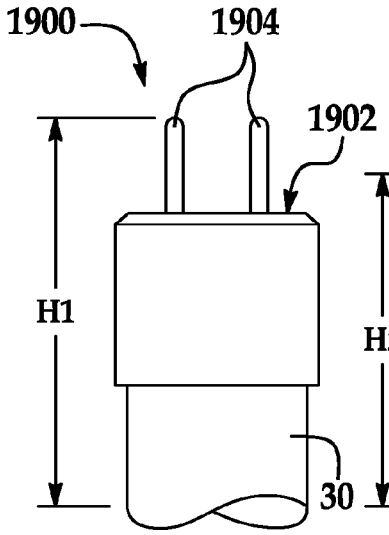
FIGS. 19A and 19B are partial perspective views of a LED-based replacement light in accordance with a nineteenth embodiment of the invention.
Figure 19B:
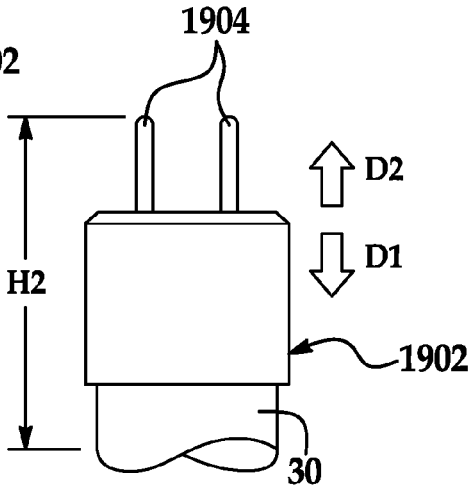

FIGS. 19A and 19B illustrate a light 1900 in accordance with a nineteenth embodiment of the present invention. The light 1900 can include two end caps 1902 (only one end cap shown in FIGS. 19A-19B) with each end cap 1902 carrying two pins 1904. One or more of the end caps 1902 can be attached to a spring or other type of biasing mechanism (not shown) located within the housing 30. The end caps 1902 of the light 1900 are biased outwardly, in the second direction D2, where the light 1900 includes a first height H1. When biased the end caps 1902 are outwardly, an open circuit condition exists within the internal circuitry of the tube 30 (not shown), an electrical connection does not exist. As a result, current does not flow to the pins 1904, thereby reducing or removing the risk of shock to the installer.

As the installer installs one of the ends of the light 1900 into the fixture, the force exerted by pressing the respective end of the light tube 1900 into the fixture actuates one or both of the end caps 1902 in the first direction D1, which axially retracts the end caps 1902 to a smaller second height H2, and is illustrated in FIG. 19B. As the end cap 1902 moves inwardly in towards the first direction D1, the pins 1904 electrically connect with the internal circuitry located within the tube 30, and the electrical circuit is closed, thereby allowing current to flow to the pins 1904. Once the light 1900 is removed from the lighting fixture, the end caps 1902 spring back by the force exerted by the biasing mechanism located within the housing 30 towards the second direction D2, and current can no longer flows to the pins 1904.

Figure 20A:
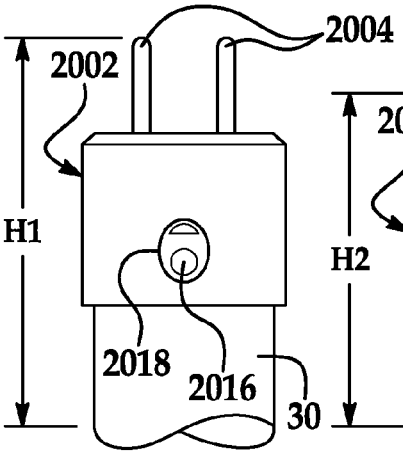
FIGS. 20A and 20B are partial perspective views of a LED-based replacement light in accordance with a twentieth embodiment of the invention.
Figure 20B:
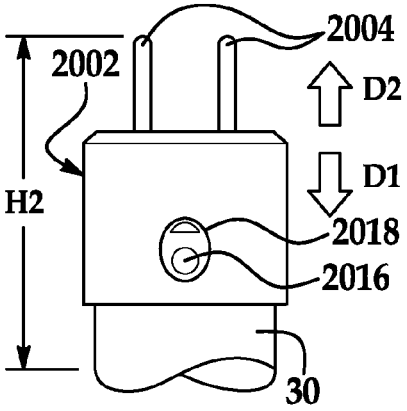

FIGS. 20A and 20B illustrate a light 2000 in accordance with a twentieth embodiment of the present invention. The light 2000 can include, similar to the nineteenth embodiment, two end caps 2002 (only one end cap shown in FIGS. 20A-20B) with each end cap 2002 carrying two pins 2004. Like the nineteenth embodiment, the end caps 2002 of the light 2000 are biased outwardly, in the second direction D2, where the light 2000 includes the first height H1. The end caps 2002 can be compressed in the first direction D1 to the second height H2, where an electrical connection is established between the pins 2004 and internal circuitry located within the tube 30 to allow current to flow to the pins 2004. However, unlike the nineteenth embodiment, a manual locking slide 2016 is included and is slidable within a groove 2018. The slide 2016 locks the biasing mechanism located within the tube 30 (not shown) in place when the light 2000 is in the open circuit condition and includes the first height H1. When locked by the slide 2016, the end caps 2002 are unable to move in the first direction D1 to deliver current to the pins 2004 unless the installer manually unlocks the slide 2016.

The installer first moves the slide 2016 within the groove 2018, thereby unlocking the biasing mechanism and allowing the end caps 2002 to actuate from the first height H1 to the second height H2. The installer then places the ends of the light tube 2000 into the lighting fixture, where the force exerted by pressing the respective end of the light tube 2000 into the fixture urges one or both of the end caps 2002 in the first direction D1, and the pins 2004 electrically connect with the internal circuitry located within the tube 30. In alternative embodiments, a button, knob or other suitable device can be used in lieu of slide 2016.

Figure 21:
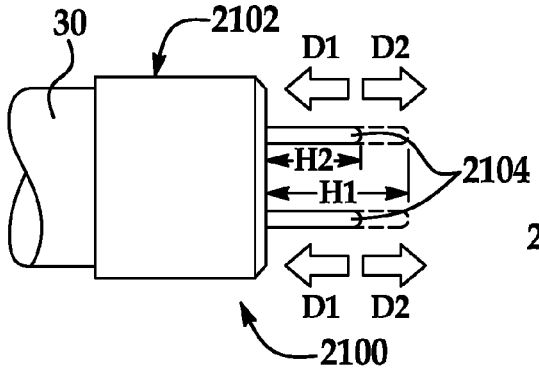
FIG. 21 is a partial perspective view of a LED-based replacement light in accordance with a twenty-first embodiment of the invention.

FIG. 21 illustrates a light 2100 in accordance with a twenty-first embodiment of the present invention. The light 2100 can include two end caps 2102 (only one end cap shown in FIG. 21) with each end cap 2102 carrying two pins 2104. Unlike the nineteenth and twentieth embodiments, one or both of the pins 2104, instead of the end caps 2102, can be actuated to close an electrical circuit. The pins 2104 can be attached to a spring or other type of biasing mechanism (not shown) located within the end cap 2102. The pins 2104 of the light 2100 are biased outwardly, towards the second direction D2, where the pins 2104 include a first height H1. When biased outwardly, the pins 2104 do not electrically connect to the internal circuitry in the tube 30, and an open circuit condition exists. As a result, current does not flow to the pins 2104, thereby reducing or removing the risk of shock to the installer.

As the installer installs one of the ends of the light tube 2100 into the fixture, the force exerted by pressing the respective end of the light tube 2100 into the fixture actuates one or both of the pins 2104 in the first direction D1, and axially retracts the pins 2104 into a smaller second height H2. When moved inwardly towards the first direction D1, the pins 2104 electrically connect with the internal circuitry located within the tube 30. The electrical circuit is closed, thereby allowing current to flow to the pins 2104.

Figure 22:
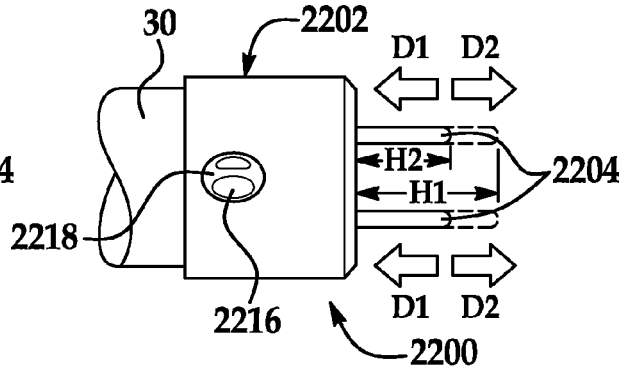
FIG. 22 is a partial perspective view of a LED-based replacement light in accordance with a twenty-second embodiment of the invention.

FIG. 22 illustrates a light 2200 in accordance with a twenty-second embodiment of the present invention. The light 2200 can include, similar to the twenty-first embodiment, two end caps 2202 (only one end cap shown in FIG. 22) with each end cap 2202 carrying two pins 2204. Like the twenty-first embodiment, the pins 2204 of the light 2200 are biased outwardly, in the second direction D2, where the pins 2204 include the first height H1. The pins 2204 can be compressed inwardly towards the first direction D1 to the second height H2, where an electrical connection is established between the pins 2204 and internal circuitry located within the tube 30 to allow current to flow to the pins 2204. However, unlike the twenty-first embodiment, a manual locking slide 2216 is included and is slidable within a groove 2218. The slide 2216 locks the biasing mechanism located within the tube 30 (not shown) in place when the light 2200 is in the open circuit condition and includes the first height H1. When locked by the slide 2216, the pins 2204 are unable to move in the first direction D1 unless the installer manually unlocks the slide 2016.

The installer first moves the slide 2216 within the groove 2218, thereby unlocking the biasing mechanism and allowing the pins 2204 to actuate from the first height H1 to the second height H2. The installer then places the ends of the light tube 2200 into the lighting fixture, where the force exerted by pressing the respective end of the light tube 2200 into the fixture urges one or both of the pins 2204 in the first direction D1. The pins 2204 can then electrically connect with the internal circuitry located within the tube 30. In alternative embodiments, a button, knob or other suitable device can be used in lieu of slide 2216.

Figure 23:
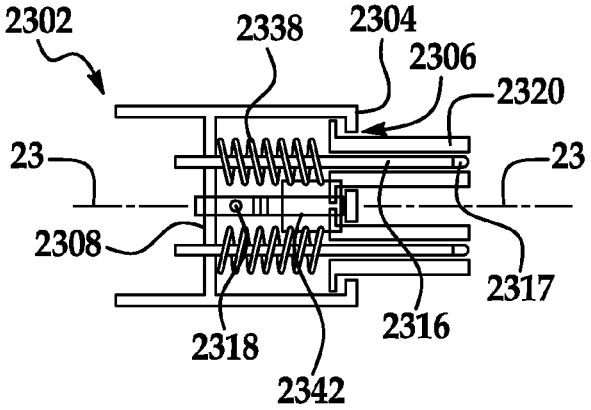
FIG. 23 is a cross-sectional view of an end cap for a LED-based replacement light in accordance with a twenty-third embodiment of the invention.
Figure 24:
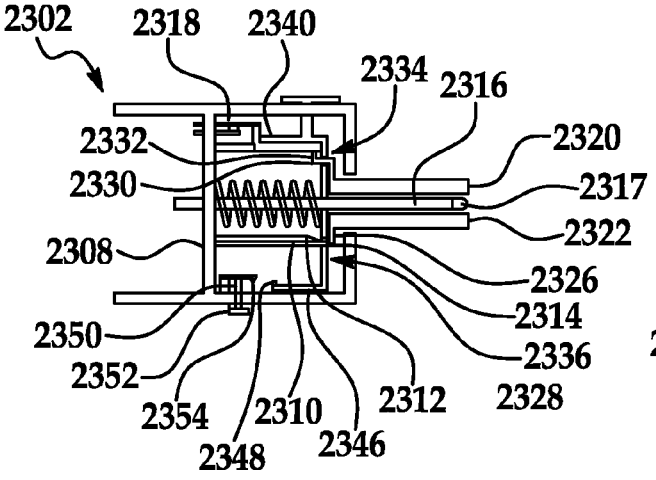
FIG. 24 is another cross-sectional view of the end cap of FIG. 23.
Figure 25:
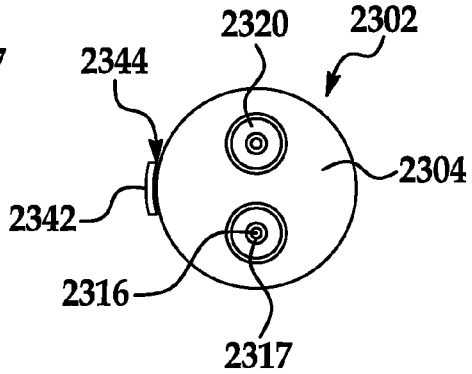
FIG. 25 is an end view of the end cap of FIG. 23.

FIGS. 23-25 show an example of an end cap 2302 that can be used as part of an LED-based light in conjunction with, e.g., housing 30, one or more LEDs, and other components. As an example, a pair of the end caps 2302 can be attached to housing 30 of light 100 in place of end caps 102.

Each end cap 2302 can include an outer axial end 2304 defining a pair of apertures 2306, though the end 2304 can define a different number of apertures 2306. Each end cap 2302 can also include a base 2308 spaced axially inward (i.e., toward a center of a light the end cap 2302 is attached to along axis 23-23 as shown in FIG. 23) from the end 2304. A tang 2310 can extend in the axial direction from the base 2308 toward the end 2304. The tang 2310 can include a ramped section 2312 and a distal end 2314 spaced further from the base 2308 than the ramped section 2312, and the distal end 2314 can be flat. The tang 2310 can be flexible and resilient such that it can bend laterally when pressure is applied to the ramped section 2312 in the axial direction and can remain straight if pressure is applied to the distal end 2314 in the axial direction. For example, the tang 2310 can be made from an elastomer.

A pin 2316 can extend through each aperture 2306, and the pins 2316 can be spaced apart, sized, and otherwise configured to engage with a standard fluorescent fixture. Each pin 2316 can be made from an electrically conductive material (e.g., copper, aluminum, or another conductor) and can include a tip 2317 made from an insulating material. While a two pin 2316 and two aperture 2306 configuration can be used for many common fixtures, other numbers of pins 2316 can alternatively be used (e.g., a single pin 2316 configuration). Each pin 2316 can extend through the base 2308 to a side of the base 2308 opposite the end 2304. Alternatively, the pins 2316 can be in electrical connection with components on an opposing side of the base 2316 from the end 2304 without extending therethrough, such as by being connected to wires that pass across the base 2308.

One or more of the pins 2316 can be electrically connected to a pair of switch contacts 2318, which are fixed to the base 2308 in the example shown in FIGS. 23-25 but can be located elsewhere in the end cap 2302 or light which the end cap 2302 is a part of. The switch contacts 2318 can move between an open position in which an electric circuit including one or more of the pins 2316 is open and a closed position in which the electric circuit including the one or more pins 2316 is closed. The switch contacts 2318 can include a spring or other biasing member that urges the switch contacts 2318 to the closed position as a default position when no other force is applied. Insulating sleeves 2320 can be formed of a high-dielectric material such as a thermoplastic. The insulating sleeves 2320 can include cylindrical shapes with an annular cross-section sized to fit around respective pins 2316. The insulating sleeves 2320 can be slidably arranged about respective pins 2316. The length of the insulating sleeves 2320 can be such that distal ends 2322 of the sleeves 2320 extend axially at least as far as the insulating tips 2317 of the pins 2316 relative to end 2304 when the sleeves 2320 are in a pin-protecting position discussed in greater detail below. One or more of the sleeves 2320 can define a flange 2326 that extends radially outward relative to its sleeve 2320, and at least a portion of the flange 2326 can be axially aligned with the flat distal end 2314 of the tang 2310.

The insulating sleeves 2320 can be connected to a platform 2328. The connection can include an extension 2330 portion of the sleeves 2320 having a tab 2332, and the extension 2330 can pass through an aperture 2334 in the platform 2328 such that the tab 2332 is on an opposing side of the platform 2328 from the sleeves 2320. The length of the extension 2330 along axis 23-23 can be as long as or longer than the distance between the distal end 2314 and the ramped section 2312 of the tang 2310.

The platform 2328 can be slidably arranged in the end cap 2302 between the end 2304 and the base 2308. The platform 2328 can define a slot 2336. One end of the slot 2336 can be axially aligned with an end of the ramped section 2312 of the tang 2310 such that the slot 2336 overlays the distal end 2314 of the tang 2310 but not its ramped section 2312. Additionally, the flange 2326 of the insulating sleeves 2320 can extend a portion of the distance across the slot 2336. An opposing end of the slot 2336 can be further radially outward than the flange 2326. One or more biasing members, such as the illustrated springs 2338 positioned around respective pins 2316, can bias the platform 2328 toward the end 2304.

A sliding actuator 2340 can be joined to or formed integrally with the platform 2328. The sliding actuator 2340 can include a knob 2342 extending to an exterior of the end cap 2302 and slidable along a slot 2344 defined by the end cap 2302. The knob 2342 can thus be accessible to, e.g., an installer of a light including the end cap 2302. The knob 2342 can include a knurled surface to enhance an installer's grip. The sliding actuator 2340 can be positioned relative to the switch contacts 2318 such that when the knob 2342 is urged along the slot 2344 a predetermined distance toward the platform 2328, the sliding actuator 2340 contacts the switch contacts 2318 and urges the switch contacts 2318 into the open position.

A latch receiver 2346 can also be joined to or formed integrally with the platform 2328. The latch receiver 2346 can include a protuberance 2348 spaced from the platform 2328. Alternatively, instead of the protuberance 2348, the latch receiver 2346 can include another structure that can be selectively engaged, such as an aperture.

The end cap 2302 can include a latch 2350. The latch 2350 can define a release button 2352 extending to an exterior of the end cap 2302 and a chamfered hook 2354 on the interior of the end cap 2302. The latch 2350 can be moveable between a resting position and an actuated position. The latch 2350 can also include a biasing member, e.g., a spring, that biases the latch 2350 toward the resting position. The latch 2350 can be positioned such that the chamfered hook 2354 engages the protuberance 2348 of the latch receiver 2346 when the latch receiver 2346 is urged a predetermined distance toward the base 2308. The chamfered hook 2354 can have a generally triangular shape or another shape that allows the protuberance 2348 of the latch receiver 2346 to pass in one direction and to prevent the latch receiver 2346 from moving in an opposing direction. Actuation of the release button 2352 can bias the latch 2350 such that the chamfered hook 2354 disengages the protuberance 2348.

When a light including the end caps 2302 is not installed in a fixture, the insulating sleeves 2320 can be in the pin-protecting position. For example, when a light including the end caps 2302 is purchased the insulating sleeves 2320 can come in the pin-protecting position. With the insulating sleeves 2320 in the pin-protecting position, the insulating sleeves 2320 are fully extended and protect the pins 2316. Additionally, the tang 2310 contacts the flange 2326, thereby hindering movement of the insulating sleeves 2320 away from the pin-protecting position.

Also with the insulating sleeves 2320 in the pin-protecting position, the sliding actuator 2340 is not engaged with the switch contacts 2318, which remain in the closed position. However, since the insulating sleeves 2320 protect the pins 2316 in the pin-protecting position, the risk of an electrical shock is reduced or eliminated with the insulating sleeves 2320 in the pin-protecting position even though the switch contacts 2318 are in the closed position. Further, installation of a light including the end caps 2302 would be difficult or not possible with the insulating sleeves 2320 in the pin-protecting position because the light would not likely fit into a fixture with the insulating sleeves 2320 fully protracted to the pin-protecting position. Also with the insulating sleeves 2320 in the pin-protecting position the latch receiver 2346 is spaced from and not engaged with the latch 2350.

Prior to installing a light including the end caps 2302 in a fixture, an installer can move the insulating sleeves 2320 from the pin-protecting position to a pin-exposing position by urging the knob 2342 away from the end 2304. As the knob 2342 is initially urged away from the end 2304, the insulating sleeves 2320 do not move because the tab 2332 of the sleeves 2320 is spaced from the platform 2328 by the length of the extension 2330. However, the initial movement of the knob 2342 moves the platform 2328 relative to the tang 2310, and the distal end 2314 of the tang 2310 passes through the slot 2336 in the platform 2328. The platform 2328 then contacts the ramped section 2312 of the tang 2310. Due to the angle of the ramped section 2312, the platform 2328 urges the tang 2310 laterally through the slot 2336 in the platform 2336, bending the tang 2310. With the tang 2310 bent, the distal end 2314 of the tang 2310 no longer contacts the flange 2326 of the insulating sleeves 2320.

After the knob 2342 moves the length of the extension 2330 of the insulating sleeves 2320, the sliding actuator 2340 contacts the tab 2332 of the insulating sleeves 2320. Once the sliding actuator 2340 contacts the tab 2332, additional movement of the knob 2342 toward the base 2308 moves the insulating sleeves 2320. Thus, the insulating sleeves 2320 are not prevented by the tang 2310 from moving toward the base 2308.

As mentioned above, when the knob 2342 is moved a predetermined distance, the sliding actuator 2340 engages the switch contacts 2318 and biases the switch contacts 2318 to their open position. With the switch contacts 2318 in their open position, the electric circuit including the pins 2316 is open. As a result, current would not flow through the pins 2316 even if a current were applied to the pins 2316, such as if the light were installed in the fixture. Since current does not flow through the pins 2316 when the insulating sleeves 2320 are in the pin-exposing position, the risk of shock to an installer is reduced or eliminated.

Also when the insulating sleeves 2320 are in the pin-exposing position, the latch 2350 can engage the latch receiver 2346. As a result, even though the springs 2338 urge the insulating sleeves 2320 from the pin-exposing position to the pin-protecting position by applying a force to the platform 2328, the engagement between the latch 2350 and latch receiver 2346 can retain the insulating sleeves 2320 in the pin-exposing position. By retaining the insulating sleeves 2320 in the pin-exposing position, the switch contacts 2318 are retained in the open position and the risk of shock remains reduced or eliminated.

With the insulating sleeves 2320 in the pin-exposing position, the installer can position the light including the end caps 2302 in the fixture. Since the switch contacts 2318 remain in the open position, current does not flow through the pins 2316. Once the light is in the fixture, the installer can actuate the release button 2352. Actuation of the release button 2352 can eliminate the engagement between the latch 2350 and latch receiver 2346, which in turn can allow the springs 2338 to bias the platform 2328 toward the end 2304. Movement of the platform 2328 toward the end 2304 also moves the sliding actuator 2340, which can allow the switch contacts 2318 to return to the closed position. The insulating sleeves 2320 can move toward the pin-protecting position, although the fixture that the light is now installed in can prevent the sleeves 2320 from reaching the pin-protecting position. As such, the pins 2316 can remain partially exposed. Thus, the pins 2316 can be electrically connected to the fixture and, since the switch contacts 2318 are in the closed position, to other components in the light such as LEDs.

Upon removal of the light from the fixture, the springs 2338 urge the insulating sleeves 2320 back to the pin-protecting position. Thus, the end caps 2302 can reduce or eliminate the shock risk associated with LED-based lights prior to installation, during installation, after installation, and upon removal. In alternative examples, the end cap 2302 can include other features. For example, a note can be included on the end cap 2302 behind the knob 2342 when the insulating sleeves 2320 are in the pin-protecting position that becomes visible when the knob 2342 is moved toward the base 2308 and that alerts an installer to press the release button 2352 after installing the light. Also in alternative examples, the end cap 2302 need not include certain features, such as the tang 2310 and/or the latch 2350 and latch receiver 2346.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. An LED-based light for replacing a fluorescent bulb in a conventional fluorescent light fixture comprising:
- at least one LED;
- an elongate housing for the at least one LED;
- an end cap disposed at a first end of the housing, the end cap including at least one electrically conductive pin configured for physical and electrical connection to the light fixture;
- a pin cover extending from the end cap, the pin cover substantially enclosing the at least one pin in a protracted position, and supported for retraction into the end cap from the protracted position to at least partially expose the at least one pin;
- circuitry configured to provide a current path between the at least one LED and the at least one electrically conductive pin; and
- a system for retracting the pin cover from the protracted position and selectively disconnecting the current path, the system including a movable projection coupled to the pin cover, wherein manual movement of the projection actuates retraction of the pin cover from the protracted position and engages a switch to create an open circuit condition in the current path.

2. An LED-based light, comprising:
- at least one LED;
- an elongate housing for the at least one LED;
- an end cap disposed at a first end of the housing, the end cap including at least one pin configured for connection to a fluorescent light fixture;
- a pin cover, the pin cover substantially enclosing the at least one pin in a protracted position, and supported for retraction from the protracted position to at least partially expose the at least one pin; and
- a system for retracting the pin cover from the protracted position, the system including a movable projection coupled to the pin cover, wherein manual movement of the projection actuates retraction of the pin cover from the protracted position.

3. The LED-based light of claim 2, wherein the projection is supported for slidable movement along an outer circumferential portion of the LED-based light.

4. The LED-based light of claim 2, wherein the projection is supported for movement in a direction of a longitudinal axis of the housing.

5. The LED-based light of claim 2, wherein the projection is defined by one of a slide lever or a button supported for slidable movement in a direction of a longitudinal axis of the housing within a groove defined along an outer circumferential portion of the LED-based light.

6. The LED-based light of claim 2, wherein the pin cover extends from the end cap in the protracted position, and is sized and supported for retraction into the end cap from the protracted position.

7. The LED-based light of claim 2, wherein the end cap includes a bi-pin configured for connection to a fluorescent light fixture, and the pin cover includes a pair of insulating sleeves concentric with the respective pins of the bi-pin.

8. The LED-based light of claim 2, wherein the pin cover is biased against retraction from the protracted position.

9. The LED-based light of claim 2, wherein the system for retracting the pin cover from the protracted position includes a locking mechanism configured to latch the pin cover in the protracted position and selectively unlatch the pin cover for retraction from the protracted position.

10. The LED-based light of claim 9, wherein manual movement of the projection actuates the locking mechanism to unlatch the pin cover for retraction from the protracted position.

11. The LED-based light of claim 9, wherein manual movement of the projection in a first direction actuates the locking mechanism to unlatch the pin cover for retraction from the protracted position, and wherein, with the projection moved in the first direction, manual movement of the projection in a second direction transverse to the first direction actuates retraction of the pin cover from the protracted position.

12. The LED-based light of claim 11, wherein the first direction is radially inward to a direction of a longitudinal axis of the housing.

13. An LED-based light, comprising:

at least one LED;

an elongate housing for the at least one LED;

an end cap disposed at a first end of the housing, the end cap including at least one pin configured for connection to a fluorescent light fixture; and a pin cover extending from the end cap, the pin cover substantially enclosing the at least one pin in a protracted position, and supported for retraction into the end cap from the protracted position to at least partially expose the at least one pin.

14. The LED-based light of claim 13, wherein the pin cover extends from a base of the end cap in the protracted position and defines an outer surface sloping from the base towards a longitudinal axis of the housing.

15. The LED-based light of claim 14, wherein the pin cover is supported for retraction into the end cap from the protracted position in response to a force applied to the outer surface in a direction radially inward to a direction of the longitudinal axis of the housing.

16. The LED-based light of claim 14, wherein the pin cover includes a frustoconical body defining the outer surface.

17. The LED-based light of claim 13, wherein the end cap includes a bi-pin configured for connection to a fluorescent light fixture, and the pin cover includes a body substantially enclosing the bi-pin in the protracted position, with the body defining a pair of apertures for passing the respective pins of the bi-pin during retraction from the protracted position.

18. The LED-based light of claim 13, wherein the end cap includes a bi-pin configured for connection to a fluorescent light fixture, and the pin cover includes a pair of insulating sleeves concentric with the respective pins of the bi-pin.

19. The LED-based light of claim 13, wherein the pin cover is biased against retraction from the protracted position.

* * * * *